US012747894B2

(12) United States Patent
Lee et al.

(10) Patent No.: US 12,747,894 B2
(45) Date of Patent: Sep. 29, 2026

(54) REFRIGERATOR AND CONTROL METHOD THEREOF

(71) Applicant: SAMSUNG ELECTRONICS CO., LTD., Suwon-si (KR)

(72) Inventors: Kwanyeol Lee, Suwon-si (KR); Yonghan Kim, Suwon-si (KR); Bongsu Son, Suwon-si (KR); Jin Jeong, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 18/649,921

(22) Filed: Apr. 29, 2024

(65) Prior Publication Data

US 2024/0280301 A1 Aug. 22, 2024

Related U.S. Application Data

(63) Continuation of application No. 17/301,904, filed on Apr. 19, 2021, now abandoned.

(30) Foreign Application Priority Data

Apr. 21, 2020 (KR) ..... 10-2020-0048357

(51) Int. Cl.

| | |
|---|---|
| ***F25B 39/02*** | (2006.01) |
| ***F25B 13/00*** | (2006.01) |
| ***F25B 49/02*** | (2006.01) |

(52) U.S. Cl.

CPC ..... *F25B 39/02* (2013.01); *F25B 13/00* (2013.01); *F25B 49/02* (2013.01)

(58) Field of Classification Search

CPC ..... F25B 47/02; F25D 21/06; F25D 21/08; F25D 21/002; F25D 21/006

See application file for complete search history.

(56) References Cited

U.S. PATENT DOCUMENTS

| | | | |
|---|---|---|---|
| 10,036,585 | B2 | 7/2018 | McCollough et al. |
| 10,180,275 | B2 | 1/2019 | Koo |

(Continued)

FOREIGN PATENT DOCUMENTS

| | | | |
|---|---|---|---|
| EP | 3290831 | A1 | 3/2018 |
| JP | H05-312447 | A | 11/1993 |

(Continued)

OTHER PUBLICATIONS

KR-19990010261-A English Translation (Year: 1999).*

(Continued)

*Primary Examiner* — Frantz F Jules
*Assistant Examiner* — Devon Moore

(57) ABSTRACT

Disclosed herein is a refrigerator. The refrigerator includes a storage compartment, an evaporator configured to cool the air in the storage compartment, a first heater provided in the vicinity of the evaporator, a tray provided to accommodate water, a refrigerant pipe provided in contact with the tray and configured to cool the tray, a second heater provided in the vicinity of the refrigerant pipe, a compressor configured to supply a compressed refrigerant to at least one of the evaporator or the refrigerant pipe, and a processor configured to start an operation of the second heater after starting an operation of the first heater, and configured to start an operation of the compressor after stopping the operation of the first heater and the second heater. Accordingly, it is possible to prevent ice from being agglomerated caused by the defrosting operation.

19 Claims, 18 Drawing Sheets

(56) References Cited

U.S. PATENT DOCUMENTS

| | | | | |
|---|---|---|---|---|
| 11,473,830 | B2 * | 10/2022 | Roslindo | F25D 21/006 |
| 2005/0115252 | A1 | 6/2005 | Karlsson et al. | |
| 2012/0096887 | A1 | 4/2012 | Cho et al. | |
| 2013/0025303 | A1 | 1/2013 | Yoon et al. | |
| 2013/0167575 | A1 | 7/2013 | Hong et al. | |
| 2018/0335240 | A1 | 11/2018 | Jeong et al. | |
| 2020/0080759 | A1 * | 3/2020 | Shi | F25C 5/22 |

FOREIGN PATENT DOCUMENTS

| | | | | |
|---|---|---|---|---|
| JP | 2004-036974 | A | 2/2004 | |
| JP | 2012-251756 | A | 12/2012 | |
| KR | 10-0165025 | B1 | 1/1999 | |
| KR | 0165025 | B1 * | 1/1999 | F25D 21/004 |
| KR | 10-1999-0010261 | A | 2/1999 | |
| KR | 19990010261 | A * | 2/1999 | |
| KR | 10-0233016 | B1 | 5/2000 | |
| KR | 10-2001-0055667 | A | 7/2001 | |
| KR | 10-2010-0059524 | A | 6/2010 | |
| KR | 10-2000-0082128 | A | 7/2010 | |
| KR | 10-2015-0145705 | A | 12/2015 | |
| KR | 10-1637443 | B1 | 7/2016 | |
| KR | 10-2016-0148337 | A | 12/2016 | |
| KR | 10-2017-0072776 | A | 6/2017 | |
| KR | 10-1849103 | B1 | 6/2018 | |
| KR | 10-2019-0023257 | A | 3/2019 | |
| WO | 2019045306 | A1 | 3/2019 | |

OTHER PUBLICATIONS

KR-0165025-B1 English Translation (Year: 1999).*

International Search Report dated Jul. 15, 2021 in connection with International Patent Application No. PCT/KR2021/004431, 3 pages.

Office Action dated Nov. 3, 2023, in connection with Korean Application No. 10/2020-0048357, 14 pages.

* cited by examiner

REFRIGERATOR AND CONTROL METHOD THEREOF

CROSS-REFERENCE TO RELATED APPLICATION

This application is a continuation of application Ser. No. 17/301,904 filed on Apr. 19, 2021, which is based on and claims priority under 35 U.S.C. § 119 to Korean Patent Application No. 10-2020-0048357, filed on Apr. 21, 2020, in the Korean Intellectual Property Office, the disclosure of which is incorporated by reference herein in its entirety.

BACKGROUND

1. Field

The disclosure relates to a refrigerator, and more particularly, to a refrigerator including an ice making device capable of making ice, and a control method thereof.

2. Description of Related Art

In general, a refrigerator is a device that stores food fresh by including a storage compartment and a cold air supply device configured to supply cooled air (hereinafter referred to as "cold air") to the storage compartment. The refrigerator may further include an ice making device for making ice.

An automatic ice making device includes an ice maker configured to make ice and an ice storage in which ice made by the ice maker is stored.

In a direct cooling method among ice making methods for freezing water, a refrigerant pipe may be extended into an interior of the ice maker to freeze water. The refrigerant pipe is also provided in direct contact with an ice making tray containing water for ice-making. In this direct cooling method, the ice making tray may be cooled by the refrigerant pipe through a heat conduction method.

Due to condensation or sublimation of water vapor, frost may be formed on the refrigerant pipe of the ice maker. In order to defrost the refrigerant pipe, the refrigerator may perform a defrosting operation of the ice maker to heat the ambient air of the refrigerant pipe.

However, when the ice maker is left for a long time without the cooling operation of the ice maker after the defrosting operation of the ice maker, the ice stored in the ice storage adjacent to the ice maker may be melted and agglomerated.

SUMMARY

Therefore, it is an aspect of the disclosure to provide a refrigerator capable of preventing ice agglomeration, which is caused by a defrosting operation, by resuming an ice making operation immediately or within a short time after the defrosting operation of the ice maker, and a control method thereof.

Additional aspects of the disclosure will be set forth in part in the description which follows and, in part, will be obvious from the description, or may be learned by practice of the disclosure.

In accordance with an aspect of the disclosure, a refrigerator includes an evaporator, a first heater provided in the vicinity of the evaporator, a tray, a refrigerant pipe configured to cool the tray, a second heater provided in the vicinity of the refrigerant pipe, a compressor configured to supply a refrigerant to at least one of the evaporator or the refrigerant pipe, and a processor configured to start an operation of the second heater after starting an operation of the first heater and start an operation of the compressor in response to stopping the operation of the first heater and the second heater.

In accordance with another aspect of the disclosure, a control method of a refrigerator includes operating a compressor to supply a refrigerant to an evaporator and a refrigerant pipe, where the refrigerant pipe configured to cool a tray provided to accommodate water, starting an operation of a first heater provided in the vicinity of the evaporator in response to stopping the operating of the compressor, starting an operation of a second heater provided in the vicinity of the refrigerant pipe after the starting of the operation of the first heater, and starting the operation of the compressor in response to stopping the operation of the first heater and the second heater.

In accordance with another aspect of the disclosure, a refrigerator includes an evaporator, a first heater provided in the vicinity of the evaporator, a refrigerant pipe provided in contact with a tray, a second heater provided in the vicinity of the refrigerant pipe, a compressor configured to supply a refrigerant to at least one of the evaporator or the refrigerant pipe, and a processor configured to operate the first heater to heat the evaporator, operate the second heater to heat the refrigerant pipe, stop the operation of the second heater after stopping the operation of the first heater, and operate the compressor in response to stopping the operation of the second heater.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

Figure 1:
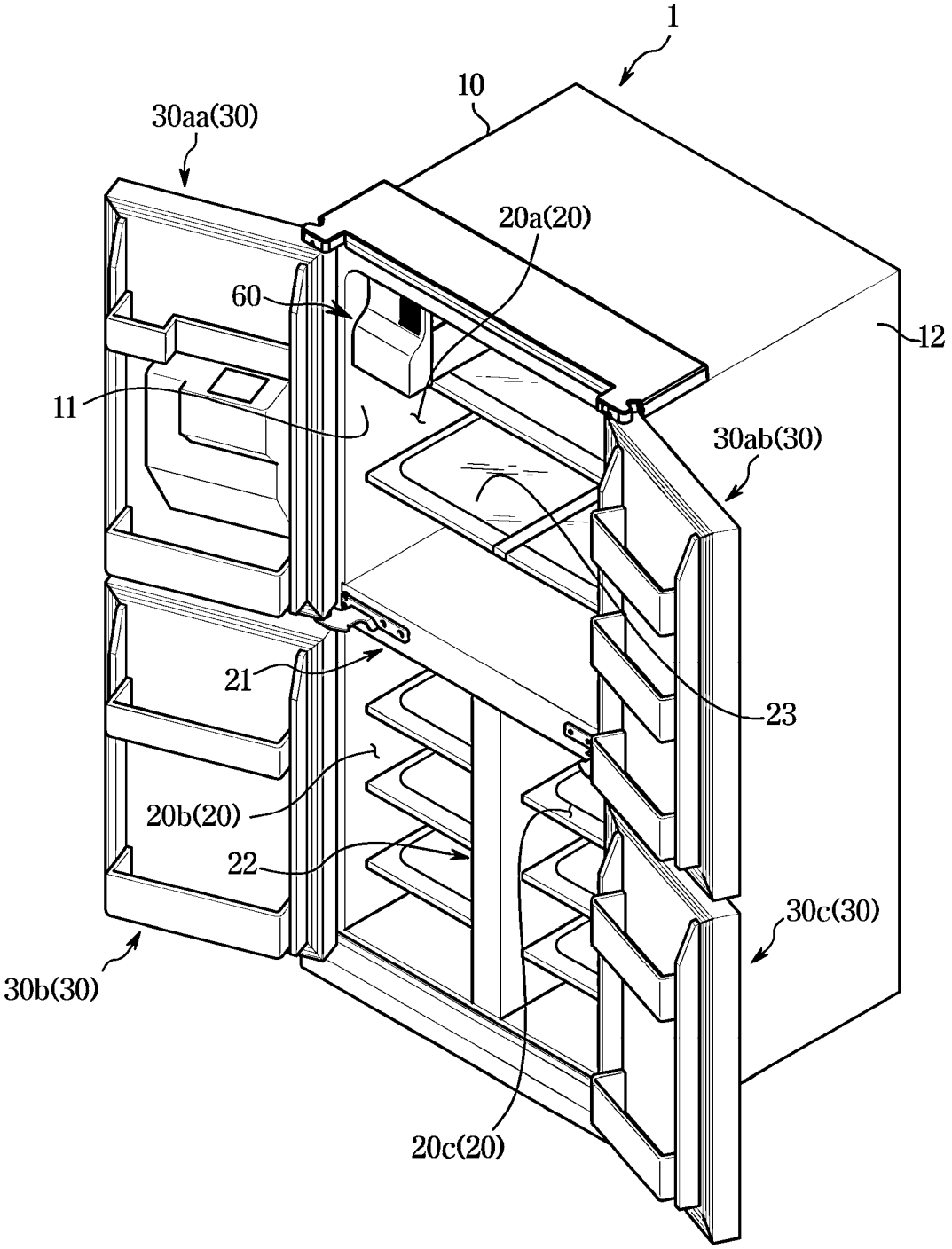
FIG. 1 is a view illustrating a refrigerator according to an embodiment of the disclosure.

FIGS. 1 through 13B, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

The following detailed description is provided to assist the reader in gaining a comprehensive understanding of the methods, apparatuses, and/or systems described herein. Accordingly, various changes, modifications, and equivalents of the methods, apparatuses, and/or systems described herein will be suggested to those of ordinary skill in the art. The progression of processing operations described is an example; however, the sequence of and/or operations is not limited to that set forth herein and may be changed as is known in the art, with the exception of operations necessarily occurring in a particular order. In addition, respective descriptions of well-known functions and constructions may be omitted for increased clarity and conciseness.

Additionally, exemplary embodiments will now be described more fully hereinafter with reference to the accompanying drawings. The exemplary embodiments may, however, be embodied in many different forms and should not be construed as being limited to the embodiments set forth herein. These embodiments are provided so that this disclosure will be thorough and complete and will fully convey the exemplary embodiments to those of ordinary skill in the art. Like numerals denote like elements throughout.

It will be understood that, although the terms first, second, etc. may be used herein to describe various elements, these elements should not be limited by these terms. These terms are only used to distinguish one element from another. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present.

The terminology used herein is for the purpose of describing particular embodiments only and is not intended to be limiting. As used herein, the singular forms "a," "an," and "the," are intended to include the plural forms as well, unless the context clearly indicates otherwise.

Reference will now be made in detail to the exemplary embodiments of the present disclosure, examples of which are illustrated in the accompanying drawings, wherein like reference numerals refer to like elements throughout.

The expression, "at least one of a, b, and c," should be understood as including only a, only b, only c, both a and b, both a and c, both b and c, or all of a, b, and c.

Figure 2:
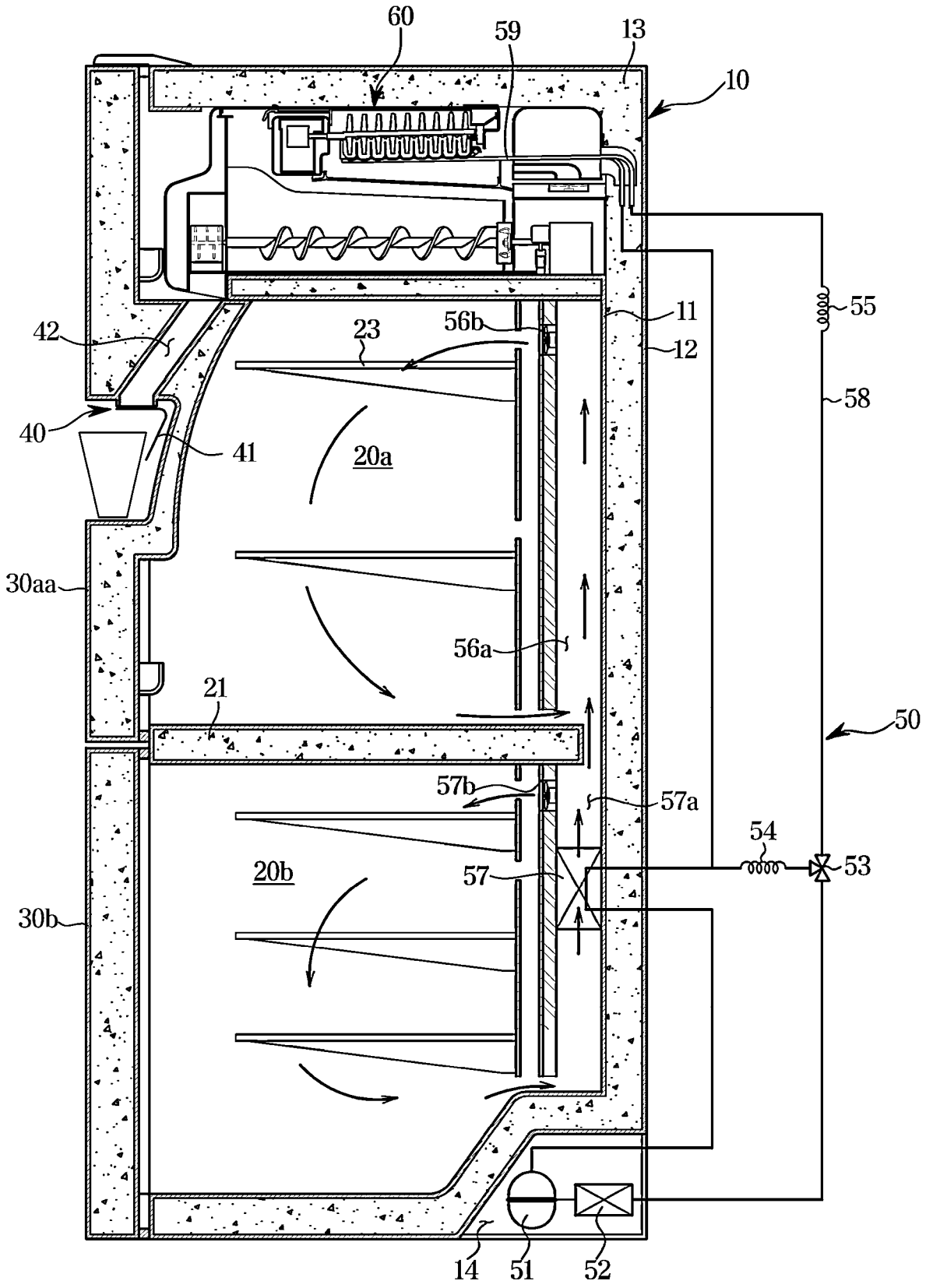
FIG. 2 is a longitudinal-sectional view of the refrigerator according to an embodiment of the disclosure.
Figure 3:
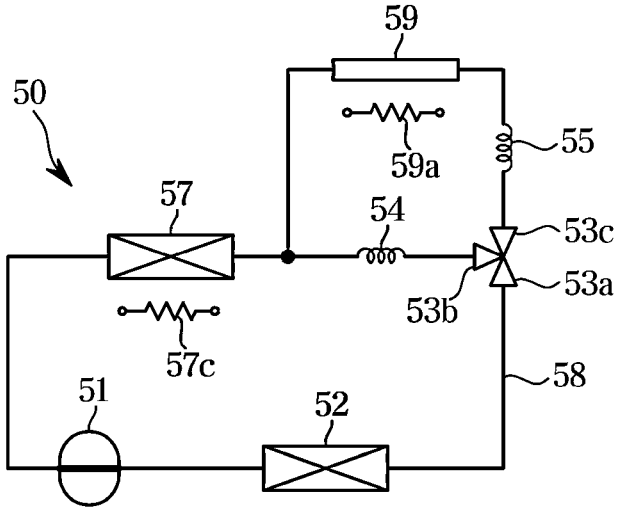
FIG. 3 is a view illustrating a refrigerant cycle of the refrigerator according to an embodiment of the disclosure.

FIG. 1 is a view illustrating a refrigerator according to an embodiment of the disclosure. FIG. 2 is a longitudinal-sectional view of the refrigerator according to an embodiment of the disclosure. FIG. 3 is a view illustrating a refrigerant cycle of the refrigerator according to an embodiment of the disclosure.

Referring to FIGS. 1, 2 and 3, a refrigerator 1 includes a main body 10 in which a front surface is open, a storage compartment 20 formed inside the main body 10 and in which refrigerated and/or frozen food is stored, a door 30 configured to open and close the open front surface of the main body 10, a cooling device 50 configured to cool the storage compartment 20 and an ice making device 60 configured to make ice.

The main body 10 forms the exterior of the refrigerator 1. The main body 10 includes an inner case 11 forming the storage compartment 20 and an outer case 12 coupled to the outside of the inner case 11. An insulating material 13 configured to prevent leakage of cold air from the storage compartment 20 is filed in between the inner case 11 and the outer case 12 of the main body 10.

The storage compartment 20 is divided into a plurality of spaces by a horizontal partition 21 and a vertical partition 22. For example, as shown in FIG. 1, the storage compartment 20 may be divided into a refrigerating compartment 20*a*, a first freezing compartment 20*b*, and a second freezing compartment 20*c*. In addition, the refrigerating compartment 20*a* may refrigerate and store food, and the freezing compartments 20*b* and 20*c* may freeze and store food. A shelf 23 on which food may be placed is provided inside the storage compartment 20. However, the number and arrangement of the storage compartments 20 are not limited to those shown in FIG. 1.

The storage compartment 20 may be opened and closed by the door 30. For example, as illustrated in FIG. 1, the refrigerating compartment 20*a* may be opened and closed by a first upper door 30*aa* and a second upper door 30*ab*. In addition, the first freezing compartment 20*b* may be opened and closed by a first lower door 30*b*, and the second freezing compartment 20*c* may be opened and closed by a second lower door 30*c*. However, the number and arrangement of the doors 30 are not limited to those shown in FIG. 1.

A dispenser 40 may be provided on one side of the door 30. The dispenser 40 may discharge water and/or ice according to a user input. In other words, through the dispenser 40, a user can directly take out water and/or ice to the outside without opening the door 30.

The dispenser 40 includes a dispenser lever 41 to which a user's discharge command is input, and a dispenser chute 42 from which ice is discharged from the ice making device 60.

The dispenser 40 may be installed on the outside of the door 30 or the main body 10. For example, the dispenser 40 may be installed on the first upper door 30*aa*. However, the location of the dispenser 40 is not limited to the first upper door 30*aa*, and thus the dispenser 40 may be installed in any position where a user can take out of water and/or ice, such as the second upper door 30*ab*, the first lower door 30*b*, the second lower door 30*c*, and the outer case 12 of the main body 10.

As illustrated in FIGS. 2 and 3, the cooling device 50 includes a compressor 51 configured to compress a refrigerant to a high pressure, a condenser 52 configured to condense the compressed refrigerant, expanders 54 and 55 configured to expand the refrigerant to a low pressure, an evaporator 57 configured to evaporate the refrigerant, and a refrigerant pipe 58 provided to guide the refrigerant.

The compressor 51 and the condenser 52 are provided in a machine room 14 provided in a rear lower portion of the main body 10.

The compressor 51 compresses a gaseous refrigerant into a high pressure, and the compressed refrigerant may be transferred to the condenser 52 through the refrigerant pipe 58. In the condenser 52, the high-pressure refrigerant is condensed, and the gaseous refrigerant may be converted to a liquid state.

The liquid refrigerant may be transferred to the expanders 54 and 55 through a switching valve 53 provided on the refrigerant pipe 58. The expanders 54 and 55 may include a first expander 54 and a second expander 55, and the first expander 54 may be connected to the evaporator 57 to be described later, and the second expander 55 may be connected to an ice making refrigerant pipe 59 to be described later. In the expanders 54 and 55, the liquid refrigerant is decompressed to a low pressure.

The liquid refrigerant, which is decompressed in the first expander 54, may be transferred to the evaporator 57 and then evaporated in the evaporator 57. During the refrigerant is evaporated in the evaporator 57, the refrigerant may absorb heat from the ambient air, and the ambient air of the evaporator 57 may be cooled due to the heat absorption of the evaporator 57.

The evaporator 57 may cool the ambient air, and the cooled air (hereinafter referred to as "cold air") may be supplied to the freezing compartments 20*b* and 20*c*.

A first cooling duct 56*a* is provided on the rear of the refrigerating compartment 20*a*, and a second cooling duct 57*a* is provided on the rear of the freezing compartments 20*b* and 20*c*. The evaporator 57 is provided in the second cooling duct 57*a* provided at the rear of the freezing compartments 20*b* and 20*c*. A first fan 56*b* is provided in the first cooling duct 56*a*. The first fan 56*b* may suck cold air, which is generated by the evaporator 57 of the second cooling duct 57*a*, through the first cooling duct 56*a* and supply the sucked cold air to the refrigerating compartment 20*a*. A second fan 57*b* configured to supply the cold air, which is generated by the evaporator 57, to the freezing compartments 20*b* and 20*c* is provided in the second cooling duct 57*a*.

A part 59 (hereinafter referred to as "ice making refrigerant pipe") of the refrigerant pipe 58 may be extended into the inside of the ice making device 60, and the ice making refrigerant pipe 59 arranged inside the ice making device 60 may cool water of the ice making device 60 for the ice-making.

The ice making device 60 may make ice by using the cold air of the ice making refrigerant pipe 59, and the ice making device 60 may be installed on one side of the storage compartment 20. For example, as shown in FIG. 1, the ice making device 60 may be provided in the upper left of the refrigerating compartment 20*a* in accordance with the dispenser 40 installed in the first upper door 30*aa*. However, the location of the ice making device 60 is not limited to that shown in FIG. 1, and thus the ice making device 60 may be provided in the freezing compartments 20*b* and 20*c*, or provided on the horizontal partition 21 between the refrigerating compartments 20*a* and the freezing compartments 20*b* and 20*c*.

As described above, the switching valve 53 configured to distribute the refrigerant to the evaporator 57 and/or the ice making device 60 is provided in the refrigerant pipe 58.

According to the operation of the switching valve 53, the refrigerant may be directly transferred to the evaporator 57 or transferred to the evaporator 57 via the ice making device 60. For example, as shown in FIG. 3, the switching valve 53 may be a three-way valve including an inlet 53*a*, a first outlet 53*b*, and a second outlet 53*c*. The inlet 53*a* is connected to the condenser 52, the first outlet 53*b* is connected to the evaporator 57 through the first expander 54, and the second outlet 53*c* is connected to the ice making refrigerant pipe 59 through the second expander 55. In response to that a flow path, which is provided to connect the inlet 53*a* to the first outlet 53*b*, is formed by the operation of the switching valve 53, the liquid refrigerant may be supplied to the evaporator 57 through the first expander 54. In addition, in response to that a flow path, which is provided to connect the inlet 53*a* to the second outlet 53*c*, is formed by the operation of the switching valve 53, the liquid refrigerant may be supplied to the ice making refrigerant pipe 59 and the evaporator 57 through the second expander 55.

A defrost heater 57*c* and 59*a* is provided in the vicinity of the evaporator 57 and the ice making refrigerant pipe 59, respectively. The defrost heaters 57*c* and 59*a*, respectively, may emit heat to remove frost on the evaporator 57 and the ice making refrigerant pipe 59. In the evaporator 57 and the ice making refrigerant pipe 59, a low-pressure liquid refrigerant may be evaporated, and during evaporation, the refrigerant may absorb heat from the ambient air. Accordingly, the ambient air may be cooled.

In addition, on the surface of the evaporator 57 and the ice making refrigerant pipe 59, water vapor may be sublimated, or may be condensed and then frozen due to cooling of the ambient air. Accordingly, frost may be formed on the surface of the evaporator 57 and the ice making refrigerant pipe 59. The defrost heaters 57*c* and 59*a* may emit heat to remove the frost formed on the evaporator 57 and the ice making refrigerant pipe 59. For example, each of the defrost heaters 57*c* and 59*a* may be an electrical resistance configured to generate Joule's Heat by current.

A first defrost heater 57*c* may be provided in the vicinity of the evaporator 57, and a second defrost heater 59*a* may be provided in the vicinity of the ice making refrigerant pipe 59. The first defrost heater 57*c* may be operated to remove frost formed on the evaporator 57, and the second defrost heater 59*a* may be operated to remove frost formed on the ice making refrigerant pipe 59.

In the drawings and the above description, the evaporator 57 provided in the second cooling duct 57*a* behind the freezing compartments 20*b* and 20*c* has been described, but is not limited thereto. For example, an additional evaporator may be provided in the first cooling duct 56*a* behind the refrigerating compartment 20*a*, and a refrigerant may be supplied to the additional evaporator by the operation of the switching valve 53. Furthermore, the first fan 56*b* may supply air, which is cooled by the additional evaporator provided in the first cooling duct 56*a*, to the refrigerating compartment 20*a*.

In addition, in the vicinity of the additional evaporator, an additional defrost heater configured to remove frost on the additional evaporator may be provided.

Hereinafter a structure and function of the ice making device 60 will be described.

Figure 4:
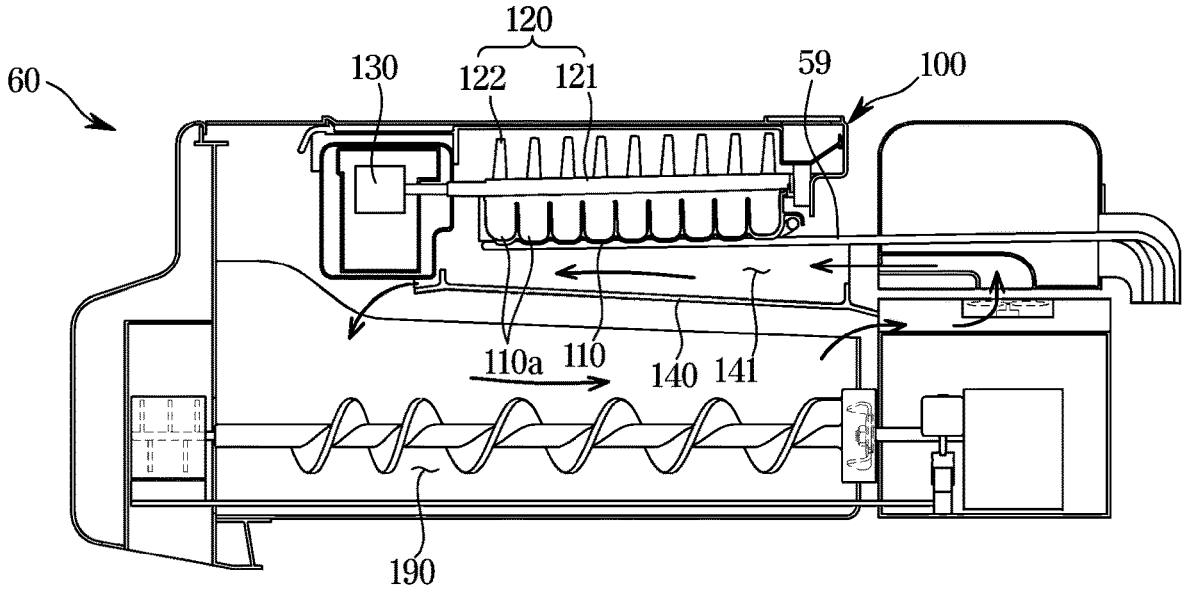
FIG. 4 is a longitudinal-sectional view of an ice making device included in the refrigerator according to an embodiment of the disclosure.
Figure 5:
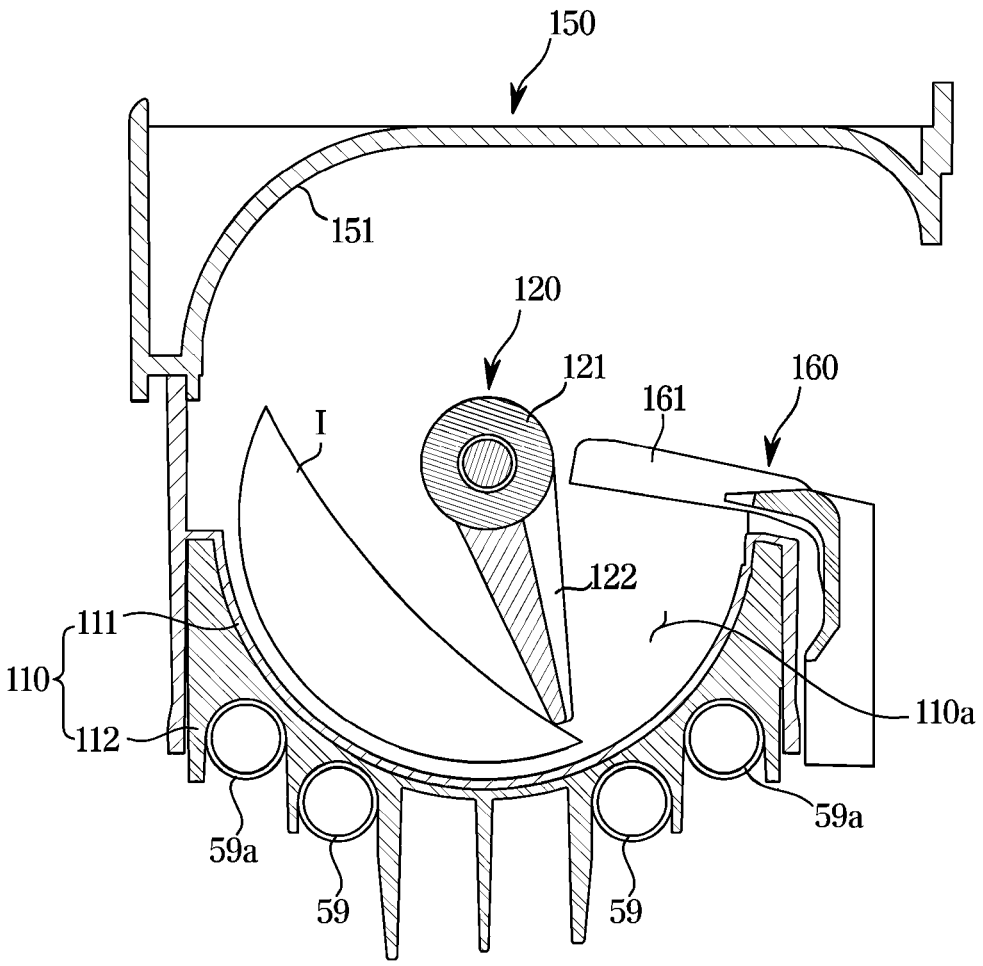
FIG. 5 is a cross-sectional view of the ice making device included in the refrigerator according to an embodiment of the disclosure.

FIG. 4 is a longitudinal-sectional view of an ice making device included in the refrigerator according to an embodiment of the disclosure. FIG. 5 is a cross-sectional view of the ice making device included in the refrigerator according to an embodiment of the disclosure.

Referring to FIGS. 4 and 5, the ice making device 60 may include an ice maker 100 and an ice storage 190.

The ice maker 100 may make ice and discharge the ice to the ice storage 190.

The ice storage 190 may store ice made by the ice maker 100. The ice storage 190 may discharge stored ice through the dispenser 40 according to a user command input through the dispenser lever 41. For example, in response to a pressure of the dispenser lever 41 by a user, the ice storage 190 may discharge ice to the outside through the dispenser 40.

The ice maker 100 includes an ice making tray 110 in which water for ice making is stored and ice is made, an ejector 120 configured to eject ice made in the ice making tray 110, an ejector motor 130 configured to rotate the ejector 120, an ice making cover 150 provided to guide ice ejected from the ice making tray 110, a slider 160 provided to prevent the ice, which is ejected from the ice making tray 110, from returning to the ice making tray 110, the second defrost heater 59*a* configured to heat the ice making tray 110 and the ice making refrigerant pipe 59 to remove the frost formed on the ice making refrigerant pipe 59 and to eject the ice of the ice making tray 110, and a cold air duct 140 provided to guide cold air of the ice making refrigerant pipe 59 to the ice storage 190.

The ice making tray 110 may include a first ice making tray 111 provided to store water for the ice making, and a second ice making tray 112 in contact with the ice making refrigerant pipe 59.

The first ice making tray 111 includes a plurality of ice making cells 110*a*, and the plurality of ice making cells 110*a* may store water for the ice-making. In addition, the first ice making tray 111 may be mounted on the second ice making tray 112 and the first ice making tray 111 may be cooled by the second ice making tray 112.

The second ice making tray 112 may be formed of a material having a high thermal conductivity, and the ice making refrigerant pipe 59 may be arranged under the second ice making tray 112. The ice making tray 110 may be cooled to a temperature below the freezing point of water (0 (zero) degrees Celsius) by the ice making refrigerant pipe 59. In addition, the second ice making tray 112 may cool the first ice making tray 111, and ice may be made as water stored in the ice making cell 110*a* of the first ice making tray 111 is frozen.

The ejector 120 is provided above the ice making tray 110, and separate the ice from the ice making tray 110 after the ice is made.

The ejector 120 includes an ejector shaft 121 configured to be rotatable and a scooping blade 122 configured to separate ice from the ice making tray 110.

The ejector shaft 121 may be connected to the ejector motor 130, and may be rotated in a clockwise or counterclockwise direction by receiving a rotational force from the ejector motor 130.

The scooping blade 122 is formed to protrude from a side wall of the ejector shaft 121.

The scooping blade 122 may be rotated around the ejector shaft 121 in response to the rotation of the ejector shaft 121, and during the rotation of the scooping blade 122, at least a part of the scooping blade 122 may be placed in the ice making cell 110*a*.

During the rotation of the scooping blade 122, the scooping blade 122 may separate the ice of the ice making tray 110 from the first ice making tray 111. For example, as illustrated in FIG. 5, in response to the rotation of the ejector shaft 121 in the clockwise direction, the scooping blade 122 may be rotated in the clockwise direction with respect to the ejector shaft 121. In addition, the scooping blade 122 may lift the ice I toward the clockwise direction while the scooping blade 122 is rotated in the clockwise direction.

The ejector motor 130 generates a rotational force, and rotates the ejector 120 in the clockwise or counterclockwise direction.

The ejector motor 130 may be connected to the ejector shaft 121 of the ejector 120, and the rotational force of the ejector motor 130 may be transmitted to the ejector shaft 121 of the ejector 120.

The ice making cover 150 guides the ice separated from the ice making tray 110 to the ice storage 190. Ice lifted by the scooping blade 122 may be guided to the slider 160 along an inner wall 151 of the ice making cover 150. The ice may not pass between guide protrusions 161 of the slider 160 and may fall downward along the guide protrusions 161 of the slider 160.

The ice making refrigerant pipe 59 may have an approximately English letter 'U' shape, and may be in direct contact with a lower surface of the second ice making tray 112.

The liquid refrigerant decompressed by the second expander 55 may pass through the ice making refrigerant pipe 59. The decompressed liquid refrigerant may be vaporized while passing through the ice making refrigerant pipe 59, and the refrigerant may absorb heat from the second ice making tray 112 during vaporization. In other words, the second ice making tray 112 may be cooled by the evaporation of the refrigerant.

The second defrost heater 59*a* may have an approximately English letter 'U' shape. The second defrost heater 59*a* may be located in a direction opposite to the ice making refrigerant pipe 59. In other words, the ice making refrigerant pipe 59 may be arranged in a way that an open portion of the 'U' shape faces the rear of the ice maker 100, but the second defrost heater 59*a* may be arranged in a way that an open portion of the 'U' shape faces the front of the ice maker 100.

The second defrost heater 59*a* may be composed of an electrical resistor, and in response to the supply of the current, the second defrost heater 59*a* may generate heat by the electrical resistance.

Further, because the second defrost heater 59*a* is in direct contact with the lower surface of the second ice making tray 112, the second defrost heater 59*a* may directly heat the second ice making tray 112. Heat transferred from the second defrost heater 59*a* to the second ice making tray 112 may be transferred to the ice making refrigerant pipe 59.

Particularly, the second defrost heater 59*a* may be used to defrost the ice making refrigerant pipe 59. Due to the operation of the ice making refrigerant pipe 59, frost may be formed on the surface of the ice making refrigerant pipe 59. The frost on the surface of the ice making refrigerant pipe 59 reduces the heat exchange efficiency of the ice making refrigerant pipe 59. Accordingly, the refrigerator 1 may operate the second defrost heater 59*a* to remove the frost formed on the surface of the ice making refrigerant pipe 59.

Further, the second defrost heater 59*a* may heat the ice making tray 110 to allow the ice to be smoothly separated from the ice making tray 110 upon the separation of the ice from the ice making tray 110. Because the ice making tray 110 is heated, some of the ice in contact with the ice making tray 110 may be melted, and thus the ice may be easily moved along the inner wall of the ice making tray 110.

The cold air duct 140 may be arranged under the ice making tray 110, and the cold air duct 140 may form a cold air flow path 141, through which the cold air passes, for supplying the cold air of the ice making refrigerant pipe 59 to the ice storage 190.

Inside air of the cold air duct 140 may be cooled by the refrigerant pipe 59 and/or the ice making tray 110. The air cooled by the refrigerant pipe 59 and/or the ice making tray 110 may be moved to the ice storage 190 through the cold air flow path 141 that is the inside of the cold air duct 140. A temperature of the ice storage 190 may be maintained at a temperature below 0 (zero) degrees Celsius by the cold air introduced into the ice storage 190, and thus it is possible to prevent the ice stored in the ice storage 190 from being melted.

Figure 6:
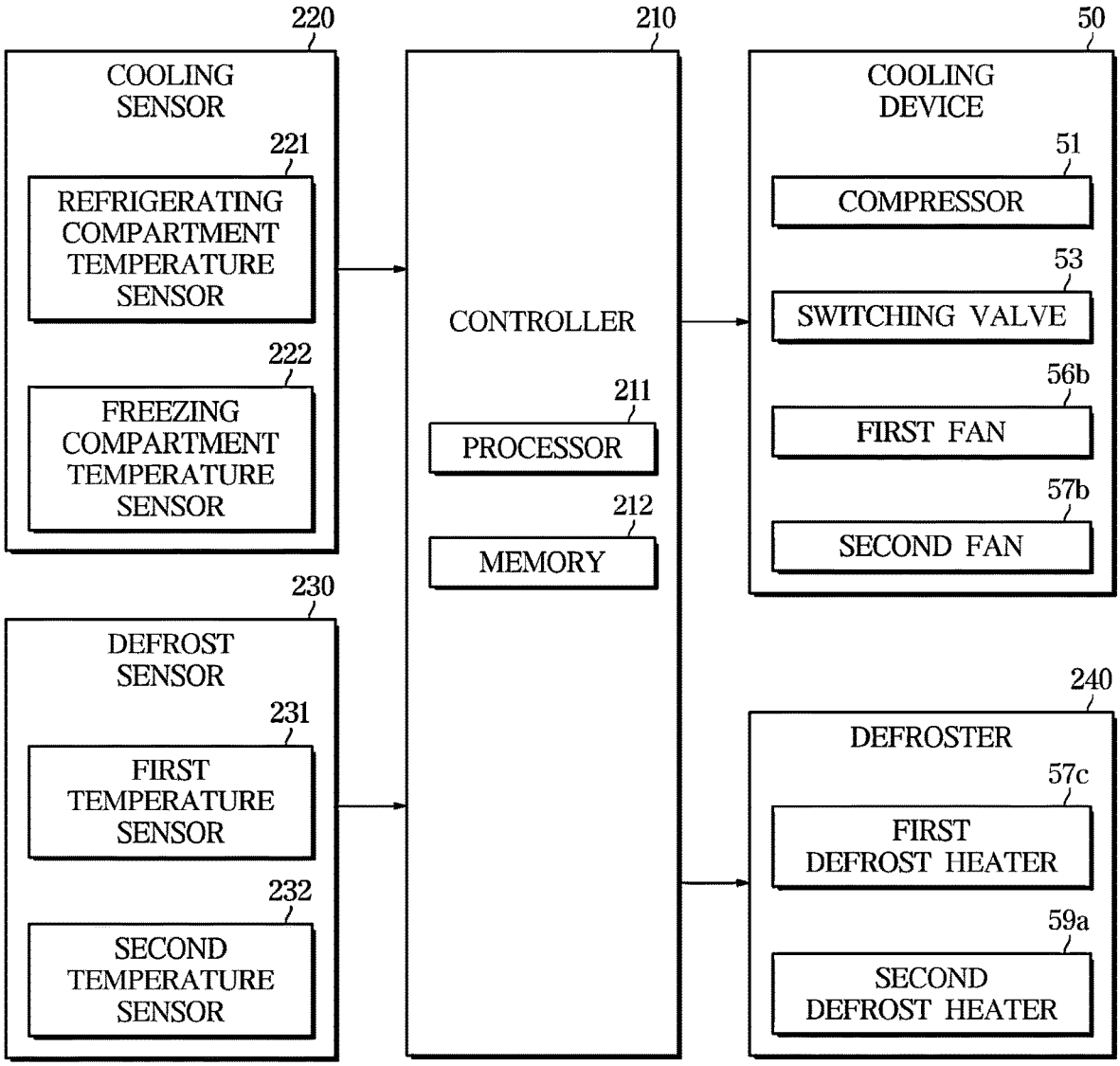
FIG. 6 is diagram illustrating electrical components of the refrigerator according to an embodiment of the disclosure.

FIG. 6 is diagram illustrating electrical components of the refrigerator according to an embodiment of the disclosure.

Referring to FIG. 6, the refrigerator 1 includes the cooling device 50, a cooling sensor 220, a defroster 240, a defrost sensor 230, and a controller 210.

The cooling device 50 includes the compressor 51, the condenser 52, the expanders 54, and 55, the evaporator 57, the switching valve 53, the first fan 56*b* and the second fan 57*b*, which are described above.

The compressor 51 and the switching valve 53 may be operated in response to a control signal from the controller 210. For example, in response to a control signal from the controller 210, the compressor 51 may compress a gaseous refrigerant and transfer the compressed refrigerant to the condenser 52. In addition, the switching valve 53 may switch the flow of the refrigerant in response to the control signal from the controller 210.

The cooling sensor 220 includes a refrigerating compartment temperature sensor 221 provided in the refrigerating compartment 20*a* and a freezing compartment temperature sensor 222 provided in the freezing compartments 20*b* and 20*c*.

The refrigerating compartment temperature sensor 221 may measure the temperature of the refrigerating compartment 20*a* configured to refrigerate and store food, and may transmit an electrical signal corresponding to the measured temperature of the refrigerating compartment 20*a* (for example, a voltage signal or a current signal) to the controller 210. The controller 210 may identify the temperature of the refrigerating compartment 20*a* based on the electrical signal received from the refrigerating compartment temperature sensor 221. The refrigerating compartment temperature sensor 221 may include a thermistor in which an electrical resistance value changes according to the temperature.

The freezing compartment temperature sensor 222 may measure the temperature of the freezing compartments 20*b* and 20*c* configured to freeze and store food, and transmit an electrical signal corresponding to the measured temperature of the freezing compartments 20*b* and 20*c* to the controller 210. The controller 210 may identify the temperatures of the freezing compartments 20*b* and 20*c* based on the electrical signal received from the freezing compartment temperature sensor 222. The freezing compartment temperature sensor 222 may include a thermistor.

The defroster 240 includes the first defrost heater 57*c* and the second defrost heater 59*a* described above.

The first defrost heater 57*c* may be provided in the vicinity of the evaporator 57, and may generate heat to remove the frost of the evaporator 57 in response to a first defrost signal of the controller 210. The second defrost heater 59*a* may be provided in the vicinity of the ice making refrigerant pipe 59, and may generate heat to remove the frost on the ice making refrigerant pipe 59 in response to a second defrost signal of the controller 210.

The defrost sensor 230 includes a first temperature sensor 231 provided in the cooling device 50 and a second temperature sensor 232 provided in the ice making device 60.

The first temperature sensor 231 may be provided in the cooling device 50, in particular, the evaporator 57, and may measure the temperature of the evaporator 57 to identify whether defrosting of the evaporator 57 is completed. The first temperature sensor 231 may transmit an electrical signal corresponding to the temperature of the evaporator 57 to the controller 210. The controller 210 may identify the temperature of the evaporator 57 based on the electric signal received from the first temperature sensor 231 and identify whether the defrosting of the evaporator 57 is completed, based on the temperature of the evaporator 57. The first temperature sensor 231 may include a thermistor.

The second temperature sensor 232 may be provided in the ice making device 60. For example, in order to identify whether defrosting of the ice making refrigerant pipe 59 is completed, the second temperature sensor 232 may directly measure the temperature of the ice making refrigerant pipe 59 or may measure the temperature of the second ice making tray 112 in contact with the ice making refrigerant pipe 59.

For example, the second temperature sensor 232 may directly measure the temperature of the ice making refrigerant pipe 59, and transmit an electrical signal corresponding to the temperature of the ice making refrigerant pipe 59 to the controller 210. The controller 210 may identify whether the defrosting of the ice making refrigerant pipe 59 is completed based on the temperature of the ice making refrigerant pipe 59.

As another example, the second temperature sensor 232 may measure the temperature of the second ice making tray 112 in contact with the ice making refrigerant pipe 59. Because the second ice making tray 112 is formed of a material having a high thermal conductivity, the temperature of the second ice making tray 112 may be similar to the temperature of the ice making refrigerant pipe 59. The second temperature sensor 232 may be in contact with the second ice making tray 112 and measure the temperature of the second ice making tray 112. The second temperature sensor 232 may transmit an electrical signal corresponding to the temperature of the second ice making tray 112 to the controller 210. The controller 210 may identify whether the defrosting of the ice making refrigerant pipe 59 is completed based on the temperature of the second ice making tray 112.

The controller 210 may be electrically connected to the cooling sensor 220, the defrost sensor 230, the cooling device 50, and the defroster 240.

The controller 210 includes a processor 211 configured to generate a control signal for controlling the operation of the refrigerator 1, and a memory 212 configured to memorize and/or store a program and data for generating a control signal. The controller 210 may include a plurality of processors or a plurality of memories. Also, the processor 211 and the memory 212 may be implemented as separate semiconductor devices, or may be implemented as a single semiconductor device.

The processor 211 may process data and/or signals according to a program provided from the memory 212 and provide control signals to each component of the refrigerator 1 based on the processing result.

The processor 211 may output a control signal for performing a cooling operation for cooling the refrigerating compartment 20*a* and/or the freezing compartments 20*b*, and 20*c* by using the cooling device 50, an ice making operation for making ice by using the ice making device 60, or a defrosting operation for removing frost formed on the evaporator 57 and/or the ice making refrigerant pipe 59.

During the cooling operation, the processor 211 may receive an electrical signal from the refrigerating compartment temperature sensor 221 and/or the freezing compartment temperature sensor 222, and may process the received electrical signal. The processor 211 may identify the temperature of the refrigerating compartment 20*a* and/or the freezing compartments 20*b* and 20*c* based on the processed electrical signal.

The processor 211 may output a control signal for controlling the operation of the compressor 51, the first fan 56*b*, and the second fan 57*b* based on the temperature of the refrigerating compartment 20*a* and/or the freezing compartments 20*b* and 20*c*. For example, the processor 211 may output a control signal for operating the compressor 51 and the first fan 56*b* based on a temperature of the refrigerating compartment 20*a* being greater than a refrigeration reference temperature (for example, 3 degrees Celsius) that is set for refrigerating and storing food. The processor 211 may output a freezing control signal for operating the compressor 51 and the second fan 57*b* based on a temperature of the freezing compartments 20*b* and 20*c* being greater than a freezing reference temperature (for example, minus 20 degrees Celsius) that is set for freezing and storing food.

The processor 211 may receive an electrical signal from the first temperature sensor 231 and process the received electrical signal. The processor 211 may identify the temperature of the evaporator 57 corresponding to the electrical signal based on the processed electrical signal.

The processor 211 may output a control signal for controlling the operation of the first defrost heater 57*c* based on the temperature of the evaporator 57. For example, the processor 211 may output a control signal for operating the first defrost heater 57*c* during the defrosting operation for removing the frost on the evaporator 57. Further, the processor 211 may output a control signal for stopping the first defrost heater 57*c* based on the temperature of the evaporator 57 being greater than a reference temperature that is for terminating the defrosting operation.

The processor 211 may receive an electrical signal from the second temperature sensor 232 configured to measure the temperature of the ice making device 60, and the processor 211 may process the received electrical signal. Based on the processed electric signal, the processor 211 may identify a temperature of the ice making device 60 (for example, the ice making refrigerant pipe or the second ice making tray) corresponding to the electric signal.

The processor 211 may output a control signal for controlling the operation of the switching valve 53 based on the temperature of the ice making device 60. For example, the processor 211 may determine the progress of ice-making based on the temperature of the ice making device 60. Based on the progress of ice-making, the processor 211 may switch the flow path by using the switching valve 53. The processor 211 may control the switching valve 53 to allow the refrigerant to pass through the ice making refrigerant pipe 59 during the ice is produced. In addition, the processor 211 may control the switching valve 53 to prevent the refrigerant from passing through the ice making refrigerant pipe 59 during the production of the ice is stopped.

In addition, the processor 211 may output a control signal for controlling the operation of the second defrost heater 59*a* based on the temperature of the ice making device 60 (for example, the ice making refrigerant pipe or the second ice making tray). For example, the processor 211 may output a control signal for operating the second defrost heater 59*a* during the defrosting operation for removing the frost on the ice making refrigerant pipe 59. In addition, the processor 211 may output a control signal for stopping the second defrost heater 59*a* based on the temperature of the ice making device 60 being greater than that reference temperature that is for terminating the defrosting operation.

The processor 211 may include an operation circuit, a memory circuit, and a control circuit. The processor 211 may include one chip or a plurality of chips. Further, the processor 211 may include one core or a plurality of cores.

The memory 212 may memorize/store programs and data for controlling the cooling operation, the ice making operation, and the defrosting operation of the refrigerator 1.

The memory 212 may include a volatile memory such as Static Random Access Memory (S-RAM), and Dynamic Random Access Memory (D-RAM), and a nonvolatile memory such as Read Only Memory (ROM), and Erasable Programmable Read Only Memory (EPROM). The memory 212 may include one memory device or a plurality of memory devices.

As described above, the controller 210 may control the cooling operation, the ice making operation and the defrosting operation of the refrigerator 1.

In the drawings and the above description, the first defrost heater 57*c* configured to remove frost on the evaporator 57 and the second defrost heater 59*a* configured to remove frost on the ice making refrigerant pipe 59 have been described, but is not limited thereto. For example, an additional evaporator may be provided in the first cooling duct 56*a* behind the refrigerating compartment 20*a*, and thus an additional defrost heater configured to remove frost formed on the additional evaporator may be provided.

Figure 7:
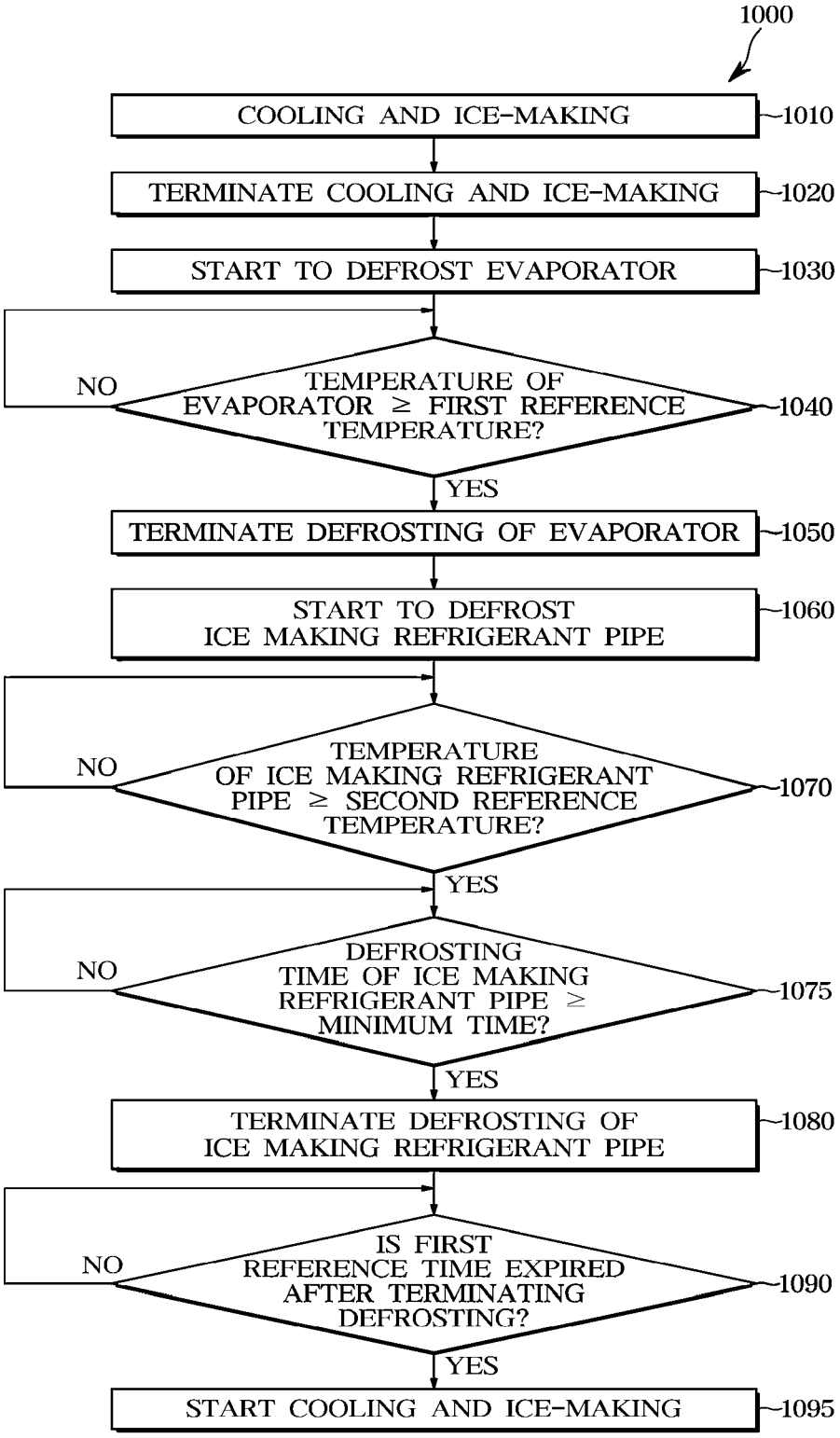
FIG. 7 is a flowchart illustrating a defrosting operation of the refrigerator according to an embodiment of the disclosure.

FIG. 7 is a flowchart illustrating a defrosting operation of the refrigerator according to an embodiment of the disclosure. FIG. 8 is a view illustrating an example of an operation of a defrost heater and an internal temperature of the ice making device by the defrosting operation shown in FIG. 7.

Defrosting (1000) of the refrigerator 1 will be described with reference to FIGS. 7 and 8.

The refrigerator 1 performs cooling and ice making of the storage compartment 20 (1010).

The controller 210 may control the cooling device 50 to supply cooled air to the storage compartment 20. For example, the controller 210 may operate the compressor 51, the first fan 56*b*, and the second fan 57*b*. Because the compressor 51 is operated, the refrigerant may be evaporated in the evaporator 57, and the air around the evaporator 57 may be cooled. Due to the operation of the first fan 56*b* and the second fan 57*b*, the cold air around the evaporator 57 may be supplied to the refrigerating compartment 20*a* and the freezing compartments 20*b* and 20*c*, respectively.

In addition, the controller 210 may control the ice making device 60 and the cooling device 50 to make ice. For example, the controller 210 may control the switching valve 53 to allow the refrigerant to be supplied to the ice making refrigerant pipe 59 during the operation of the compressor 51. The refrigerant may be evaporated in the ice making refrigerant pipe 59, and water contained in the ice making tray 110 in contact with the ice making refrigerant pipe 59 may be frozen.

The refrigerator 1 terminates the cooling and ice making (1020).

The controller 210 may terminate the cooling and ice making based on the sum of times, in which the compressor 51 is discontinuously operated, or based on a time in which the compressor 51 is continuously operated. For example, the controller 210 may terminate the cooling and ice making based on the sum of the times, in which the compressor 51 is discontinuously operated, being equal to or greater than a first defrost start time for the defrosting or based on the time, in which the compressor 51 is continuously operated, being equal to or greater than a second defrost start time for the defrosting.

In addition, the controller 210 may terminate the cooling and ice making based on the temperature of the evaporator 57 and/or the ice making device 60 (for example, the ice making tray or the ice making refrigerant pipe). For example, based on the temperature of the evaporator 57 being less than a first defrost start temperature for defrosting, or based on the temperature of the ice making device 60 being less than a second defrost start temperature for defrosting, the controller 210 may terminate the cooling and ice making.

The controller 210 may stop the compressor 51, the first fan 56*b*, and the second fan 57*b*, and close the switching valve 53 in order to terminate the cooling and ice making. Accordingly, the flow of the refrigerant in the cooling device 50 may be stopped.

The refrigerator 1 starts to defrost the evaporator 57 (1030).

The controller 210 may start to defrost the evaporator 57 after terminating the cooling and ice making.

Figure 8A:
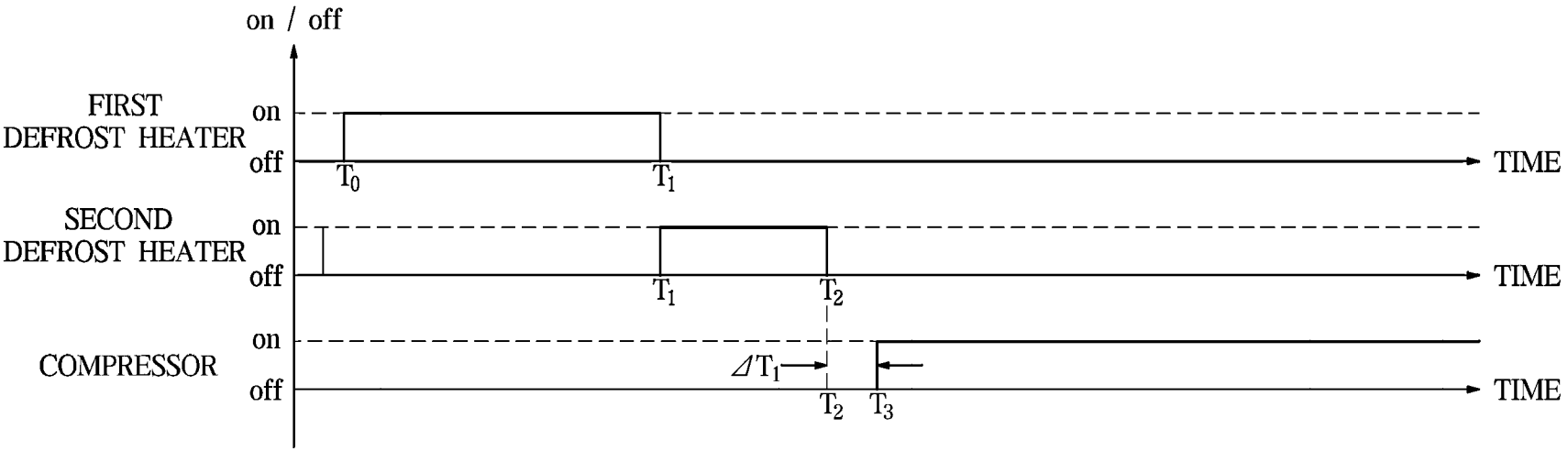
FIGS. 8A and 8B are views illustrating an example of an operation of a defrost heater and an internal temperature of the ice making device by the defrosting operation shown in FIG. 7.

During the compressor 51 is stopped and the switching valve 53 is closed, the controller 210 may operate the first defrost heater 57*c*. For example, the controller 210 may operate the first defrost heater 57*c* at a time TO after the cooling operation is terminated, as shown in FIG. 8A.

The first defrost heater 57*c* may generate heat, and heat the ambient air. Heat emitted from the first defrost heater 57*c* may be directly transferred to the evaporator 57, and the air heated by the first defrost heater 57*c* may increase an ambient temperature of the evaporator 57 by convection.

As mentioned above, the heat may be directly transferred to the evaporator 57 or the ambient air of the evaporator 57 may be heated due to the operation of the first defrost heater 57*c*. The temperature of the evaporator 57 may be increased, and the frost formed on the evaporator 57 may be melted.

The refrigerator 1 determines whether the temperature of the evaporator 57 is equal to or greater than a first reference temperature while defrosting the evaporator 57 (1040).

The controller 210 may identify the temperature of the evaporator 57 based on an output signal of the first temperature sensor 231 while operating the first defrost heater 57*c*. While operating the first defrost heater 57*c*, the controller 210 may compare the temperature of the evaporator 57 with the first reference temperature, which is set to terminate the defrosting of the evaporator 57, and may identify whether the temperature of the evaporator 57 is equal to or greater than the first reference temperature.

The first reference temperature may be set experimentally or empirically. For example, the first reference temperature may be experimentally or empirically set to a temperature at which all frost formed on the evaporator 57 is removed by the operation of the first defrost heater 57*c*.

In general, frost may have a temperature below 0 (zero) degrees Celsius, and the evaporator 57 on which frost is formed may also have a temperature below 0 (zero) degrees Celsius. Further, after the defrosting operation is completed, the temperature of the evaporator 57 may have a temperature above 0 (zero) degrees Celsius. Therefore, the first reference temperature may be a temperature above 0 (zero) degrees Celsius.

However, the temperature of the evaporator 57 may be an indicator indicating a temperature of the evaporator 57 and the first reference temperature may be an indicator indicating a first reference temperature. For example, the controller 210 may compare a voltage value indicating the temperature of the evaporator 57 with a voltage value indicating the first reference temperature, and the controller 210 may identify whether the voltage value indicating the temperature of the evaporator 57 is equal to or greater than the voltage value indicating the first reference temperature.

In response to the temperature of the evaporator 57 being less than the first reference temperature (no in 1040), the refrigerator 1 may continue to defrost the evaporator 57, and the refrigerator 1 may continue to identify whether the temperature of the evaporator 57 is equal to or greater than the first reference temperature while defrosting the evaporator 57.

In response to the temperature of the evaporator 57 being equal to or greater than the first reference temperature (yes in 1040), the refrigerator 1 terminates the defrosting of the evaporator 57 (1050).

The controller 210 may identify that at least most of the frost on the evaporator 57 is removed based on the temperature of the evaporator 57 being equal to or greater than the first reference temperature. Accordingly, the controller 210 may stop the first defrost heater 57*c* in order to terminate the defrosting of the evaporator 57. For example, the controller 210 may stop the first defrost heater 57*c* at a time T1, as shown in FIG. 8A.

After terminating the defrosting of the evaporator 57, the refrigerator 1 starts to defrost the ice making refrigerant pipe 59 (1060).

The controller 210 may operate the first defrost heater 57*c* during the compressor 51 is stopped and the switching valve 53 is closed. For example, the controller 210 may operate the first defrost heater 57*c* at the time T1 at which the defrosting of the evaporator 57 is terminated, as shown in FIG. 8A.

The second defrost heater 59*a* may generate heat and heat the ambient air. Because the second defrost heater 59*a* is in contact with the ice making tray 110, heat generated from the second defrost heater 59*a* may be conducted to the ice making tray 110. In addition, the heat conducted to the ice making tray 110 may be conducted to the ice making refrigerant pipe 59 in contact with the ice making tray 110. Accordingly, the ice making refrigerant pipe 59 and the ambient air thereof may be heated.

Figure 8B:
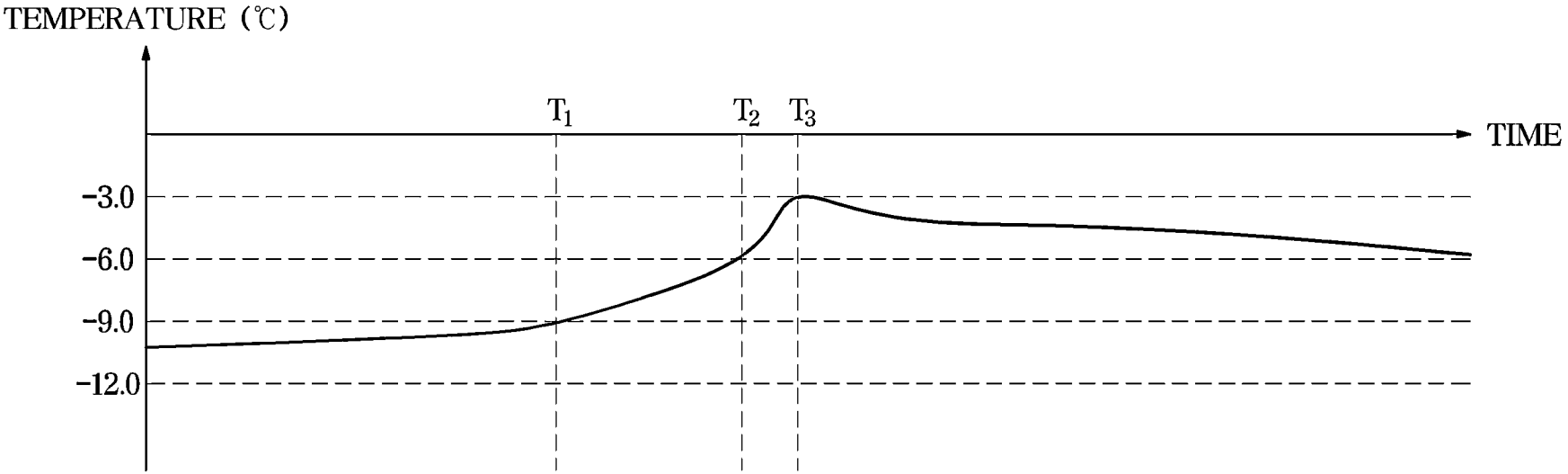

As mentioned above, the heat may be directly transferred to the ice making refrigerant pipe 59 or the ambient air of the ice making refrigerant pipe 59 may be heated due to the operation of the second defrost heater 59*a*. Accordingly, the temperature of the ice making refrigerant pipe 59 may be increased, and the frost formed on the ice making refrigerant pipe 59 may be melted. For example, as illustrated in FIG. 8B, during the second defrost heater 59*a* is operated, an internal temperature of the ice making device 60 may be gradually increased.

While defrosting the ice making refrigerant pipe 59, the refrigerator 1 determines whether the temperature of the ice making refrigerant pipe 59 is equal to or greater than a second reference temperature (1070).

While operating the second defrost heater 59*a*, the controller 210 may identify the temperature of the ice making tray 110 based on an output signal of the second temperature sensor 232. The ice making tray 110 may be in contact with the ice making refrigerant pipe 59. Heat conduction between the ice making tray 110 and the ice making refrigerant pipe 59 may be large, and a temperature difference between the ice making tray 110 and the ice making refrigerant pipe 59 may be small. Accordingly, the temperature of the ice making refrigerant pipe 59 may be easily identified based on the temperature of the ice making tray 110.

The second temperature sensor 232 may be in contact with the ice making tray 110, and the second temperature sensor 232 may measure the temperature of the ice making tray 110. As described above, because the ice making tray 110 is in contact with the ice making refrigerant pipe 59, the temperature of the ice making tray 110 measured by the second temperature sensor 232 may indicate the temperature of the ice making refrigerant pipe 59.

Accordingly, while operating the second defrost heater 59*a*, the controller 210 may identify the temperature of the ice making refrigerant pipe 59 based on an output signal of the second temperature sensor 232. While operating the second defrost heater 59*a*, the controller 210 may compare the temperature of the ice making refrigerant pipe 59 with a second reference temperature, which is set to terminate the defrosting of the ice making refrigerant pipe 59, and the controller 210 may identify whether the temperature of the ice making refrigerant pipe 59 is equal to or greater than the second reference temperature.

The second reference temperature may be set experimentally or empirically. For example, the second reference temperature may be experimentally or empirically set to a temperature at which all frost formed on the ice making refrigerant pipe 59 is removed by the operation of the second defrost heater 59*a*. For example, the second reference temperature may be a temperature above 0 (zero) degrees Celsius.

However, the temperature of the ice making refrigerant pipe 59 may be an indicator indicating a temperature of the ice making refrigerant pipe 59 and the second reference temperature may be an indicator indicating a second reference temperature. For example, the controller 210 may compare a voltage value indicating a temperature of the ice making tray 110 in contact with the ice making refrigerant pipe 59 with a voltage value indicating the second reference temperature, and the controller 210 may identify whether the voltage value indicating the temperature of the ice making tray 110 is equal to or greater than the voltage value indicating the second reference temperature.

In response to the temperature of the ice making refrigerant pipe 59 (or the ice making tray) being less than the second reference temperature (no in 1070), the refrigerator 1 may continue to defrost the ice making refrigerant pipe 59, and while defrosting the ice making refrigerant pipe 59, the refrigerator 1 may continue to identify whether the temperature of the ice making refrigerant pipe 59 (or the ice making tray) is equal to or greater than the second reference temperature.

In response to the temperature of the ice making refrigerant pipe 59 (or the ice making tray) being equal to or greater than the second reference temperature (yes in 1070), the refrigerator 1 may determine whether a defrosting time of the ice making refrigerant pipe 59 is equal to or greater than a minimum time (1075).

The refrigerator 1 may defrost the ice making refrigerant pipe 59 for at least the minimum time in order to ensure the defrosting of the ice making refrigerant pipe 59.

The controller 210 may count a period of time elapsed since the second defrost heater 59*a* is operated, and the controller 210 may determine whether the minimum time is expired since the second defrost heater 59*a* is operated, based on comparing the time, which is elapsed since the second defrost heater 59*a* is operated, with the minimum time.

In response to the defrosting time of the ice making refrigerant pipe 59 being equal to or greater than the minimum time (yes in 1075), the refrigerator 1 terminates the defrosting of the ice making refrigerant pipe 59 (1080).

The controller 210 may identify that at least most of the frost on the ice making refrigerant pipe 59 is removed, based on the temperature of the ice making refrigerant pipe 59 being equal to the second reference temperature and based on the defrosting time of the ice making refrigerant pipe 59 being equal to or greater than the minimum time. Therefore, the controller 210 may stop the second defrost heater 59*a* in order to terminate the defrosting of the ice making refrigerant pipe 59. For example, the controller 210 may stop the second defrost heater 59*a* at a time T2, as shown in FIG. 8A.

The refrigerator 1 determines whether a first reference time is expired since the second defrost heater 59*a* is stopped (1090).

The controller 210 may count a period of time elapsed since the second defrost heater 59*a* is stopped, and the controller 210 may determine whether a first reference time ΔT1 is expired since the second defrost heater 59*a* is stopped, based on comparing the time, which is elapsed since the second defrost heater 59*a* is stopped, with the first reference time ΔT1.

The controller 210 may wait for the first reference time ΔT1 after stopping the second defrost heater 59*a*. Due to the defrosting of the evaporator 57 and the defrosting of the ice making refrigerant pipe 59, an internal pressure of the refrigerant pipe 58 may be increased. In order to stabilize the pressure of the refrigerant pipe 58, the controller 210 may wait for a predetermined time after defrosting (heating) of the evaporator 57 and the ice making refrigerant pipe 59. For example, the controller 210 may wait for the first reference time ΔT1, as illustrated in FIG. 8A.

The first reference time ΔT1 may be set experimentally or empirically to stabilize the pressure of the refrigerant pipe 58.

In response to that the first reference time is not expired (no in 1090), the refrigerator 1 may continue to wait.

In response to that the first reference time is expired (yes in 1090), the refrigerator 1 starts cooling and ice making of the storage compartment 20 (1095).

After completing the defrosting of the evaporator 57 and/or the ice making refrigerant pipe 59, the controller 210 may control the cooling device 50 to supply cold air to the storage compartment 20, and the controller 210 may control the ice making device 60 and the cooling device 50 to make ice.

As described above, the refrigerator 1 may sequentially perform the defrosting of the evaporator 57 and the defrosting of the ice making refrigerant pipe 59. Particularly, the refrigerator 1 may defrost the ice making refrigerant pipe 59 after the defrosting the evaporator 57, and the refrigerator 1 may perform the cooling of the storage compartment 20 and the ice-making after the defrosting of the ice making refrigerant pipe 59.

As described above, by resuming the ice-making operation within a short period of time after performing the defrosting of the ice making refrigerant pipe 59 or upon performing the defrosting of the ice making refrigerant pipe 59, it is possible to prevent the ice stored in the ice storage 190 from being melted.

For example, in a case in which the defrosting of the evaporator 57 and the defrosting of the ice making refrigerant pipe 59 are performed at the same time, the defrosting of the ice making refrigerant pipe 59 is terminated earlier than the defrosting of the evaporator 57. In general, a capacity of the evaporator 57 is larger than a capacity of the ice making refrigerant pipe 59, and thus an amount of frost on the evaporator 57 is greater than an amount of frost on the ice making refrigerant pipe 59. Accordingly, a time for defrosting of the evaporator 57 is greater than a time for defrosting of the ice making refrigerant pipe 59.

As mentioned above, the flow path is designed to allow the refrigerant, which is passed through the ice making refrigerant pipe 59, to pass through the evaporator 57 because the capacity of the ice making refrigerant pipe 59 is small. Accordingly, the cooling and the ice-making may be performed after the defrosting of the evaporator 57 and the defrosting of the ice making refrigerant pipe 59 are completed.

As mentioned above, the period of time for defrosting the evaporator 57 is greater than the period of time for defrosting the ice making refrigerant pipe 59, and the cooling and the ice-making are performed after the defrosting of the evaporator 57 and the defrosting of the ice making refrigerant pipe 59 are completed. Therefore, the inside of the ice making device 60 after the defrosting of the ice making refrigerant pipe 59 may wait for the ice-making at a temperature above 0 (zero) degrees Celsius. Therefore, ice stored in the ice making device 60, that is, ice stored in the ice storage 190 is exposed to the air, which is heated by the second defrost heater 59*a*, for a long time, and thus the ice may be melted and agglomerated.

On the other hand, in a case in which the defrosting of the evaporator 57 and the defrosting of the ice making refrigerant pipe 59 are performed sequentially, the ice-making is resumed immediately after the defrosting of the ice making refrigerant pipe 59 (or after the first reference time). Therefore, it is possible to prevent the ice stored in the ice making device 60 from being agglomerated.

For example, as shown in FIG. 8B, the internal temperature of the ice making device 60 may be steadily increased between the time T1 and the time T2 at which the second defrost heater 59*a* is operated. In addition, even after the time T2 at which the second defrost heater 59*a* is stopped, the internal temperature of the ice making device 60 may be still increased. However, the ice making may be resumed within a short time (for example, the first reference time), and after the ice making is resumed, the internal temperature of the ice making device 60 may be gradually reduced.

Accordingly, even after the operation of the second defrost heater 59*a* is completed, the internal temperature of the ice making device 60 may be maintained at a temperature equal to or less than 0 (zero) degrees Celsius at which ice is melted. Therefore, it is possible to prevent the ice stored in the ice making device 60 from being melted.

In the drawings and the above description, it has been described that, after the defrosting of the evaporator 57 configured to supply cooled air (hereinafter referred to as "cold air") to the freezing compartments 20*b* and 20*c* is completed, the defrosting of the ice making refrigerant pipe 59 configured to make ice is started. However, it is not limited thereto. For example, the refrigerator 1 may include an additional evaporator configured to supply cold air to the refrigerating compartment 20*a*, and the defrosting of the ice making refrigerant pipe 59 may be started after the defrosting of the evaporator 57 and the defrosting of the additional evaporator are completed.

Figure 9:
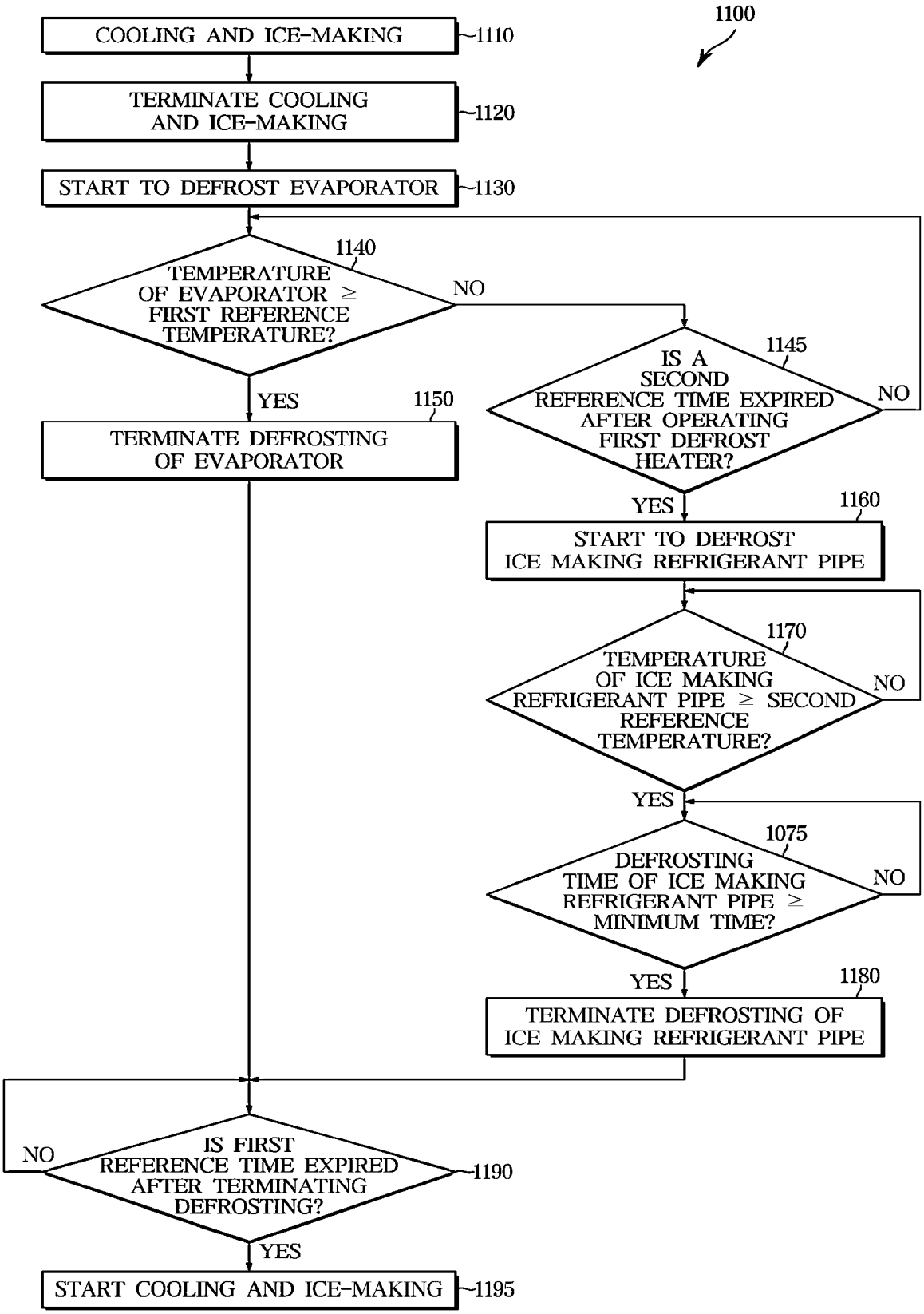
FIG. 9 is a flowchart illustrating a defrosting operation of the refrigerator according to an embodiment of the disclosure.

FIG. 9 is a flowchart illustrating a defrosting operation of the refrigerator according to an embodiment of the disclosure. FIG. 10 is a view illustrating an example of an operation of the defrost heater and an internal temperature of the ice making device by the defrosting operation shown in FIG. 9. FIG. 11 is a view illustrating another example of the operation of the defrost heater and the internal temperature of the ice making device by the defrosting operation shown in FIG. 9. FIG. 12 is a view illustrating another example of the operation of the defrost heater and the internal temperature of the ice making device by the defrosting operation shown in FIG. 9. FIG. 13 is a view illustrating another example of the operation of the defrost heater and the internal temperature of the ice making device by the defrosting operation shown in FIG. 9.

Defrosting (1100) of the refrigerator 1 will be described with reference to FIGS. 9, 10, 11, 12, and 13.

The refrigerator 1 performs cooling and ice-making of the storage compartment 20 (1110). The refrigerator 1 terminates the cooling and the ice-making (1120). The refrigerator 1 starts to defrost the evaporator 57 (1130). While defrosting the evaporator 57, the refrigerator 1 determines whether the temperature of the evaporator 57 is equal to or greater than the first reference temperature (1140).

An operation 1110, an operation 1120, an operation 1130 and an operation 1140 may be the same as the operation 1010, the operation 1020, the operation 1030, and the operation 1040 shown in FIG. 7, respectively.

In response to the temperature of the evaporator 57 being equal to or greater than the first reference temperature (yes in 1140), the refrigerator 1 terminates the defrosting of the evaporator 57 (1150).

An operation 1150 may be the same as the operation 1050 illustrated in FIG. 7.

In response to the temperature of the evaporator 57 being less than the first reference temperature (no in 1140), the refrigerator 1 determines whether a second reference time is expired since the defrosting of the evaporator 57 is started (1145). In response to that the second reference time is not expired since the defrosting of the evaporator 57 is started (no in 1145), the refrigerator 1 may repeat to determine whether the temperature of the evaporator 57 is equal to or greater than the first reference temperature, and to determine whether the second reference time is expired since the defrosting of the evaporator 57 is started. In response to that the second reference time is expired since the defrosting of the evaporator 57 is started (yes in 1145), the refrigerator 1 starts to defrost the ice making refrigerant pipe 59 (1160). While defrosting the ice making refrigerant pipe 59, the refrigerator 1 determines whether the temperature of the ice making refrigerant pipe 59 is equal to or greater than the second reference temperature (1170). In response to the temperature of the ice making refrigerant pipe 59 (or the ice making tray) being equal to or greater than the second reference temperature (yes in 1170), the refrigerator 1 determines whether the defrosting time of the ice making refrigerant pipe 59 is equal to or greater than the minimum time (1175). In response to the defrosting time of the ice making refrigerant pipe 59 being equal to or greater than the minimum time (yes in 1075), the refrigerator 1 terminates the defrosting of the ice making refrigerant pipe 59 (1180). The refrigerator 1 determines whether a third reference time is expired since the first defrost heater 57*c* and the second defrost heater 59*a* are stopped (1190). In response to the third reference time being expired (yes in 1190), the refrigerator 1 starts the cooling and ice-making of the storage compartment 20 (1195).

An operation 1160, an operation 1170, an operation 1175, an operation 1180, an operation 1190 and an operation 1195 may be the same as the operation 1060, the operation 1070, the operation 1075, the operation 1080, the operation 1090 and the operation 1095 shown in FIG. 7.

As mentioned above, before the defrosting of the evaporator 57 is terminated, the refrigerator 1 may start to defrost the ice making refrigerant pipe 59.

In response to the temperature of the evaporator 57 being less than the first reference temperature, the controller 210 may continue to defrost the evaporator 57. The controller 210 may count a period of time elapsed since the defrosting of the evaporator 57 is started, and may determine whether the time, which is elapsed since the defrosting of the evaporator 57 is started, is equal to or greater than the second reference time. In response to the elapsed time since the start of the defrosting of the evaporator 57 being equal to or greater than the second reference time, the controller 210 starts to defrost the ice making refrigerant pipe 59. In other words, in response to that the second reference time is expired since the defrosting of the evaporator 57 is started, the controller 210 may start to defrost the ice making refrigerant pipe 59.

The second reference time may be set experimentally or empirically for various purposes.

Figure 10A:
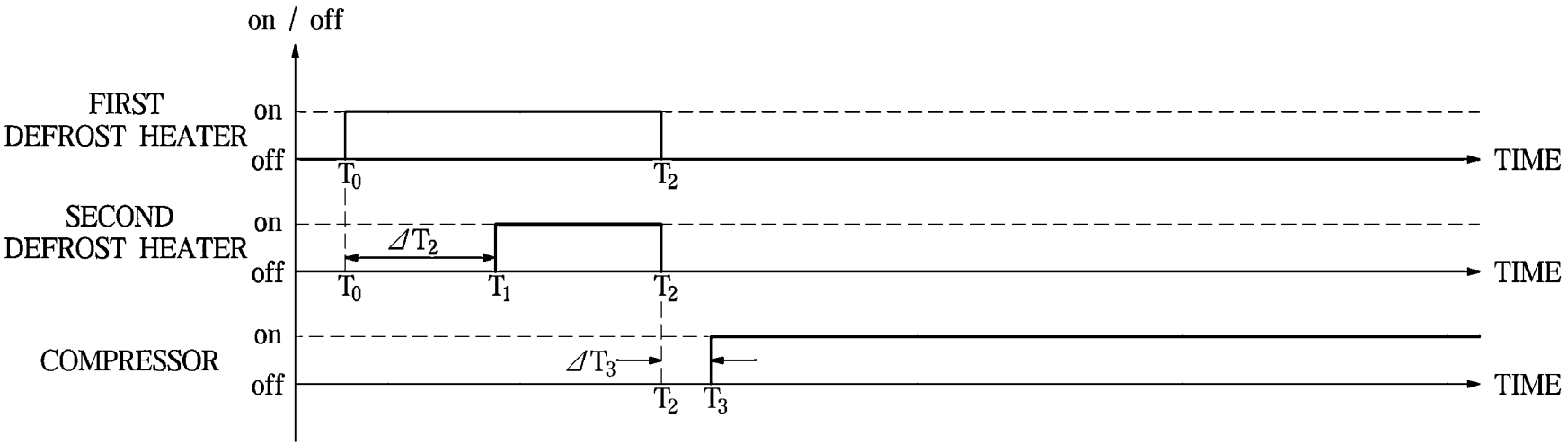
FIGS. 10A and 10B are views illustrating an example of an operation of the defrost heater and an internal temperature of the ice making device by the defrosting operation shown in FIG. 9.
Figure 10B:
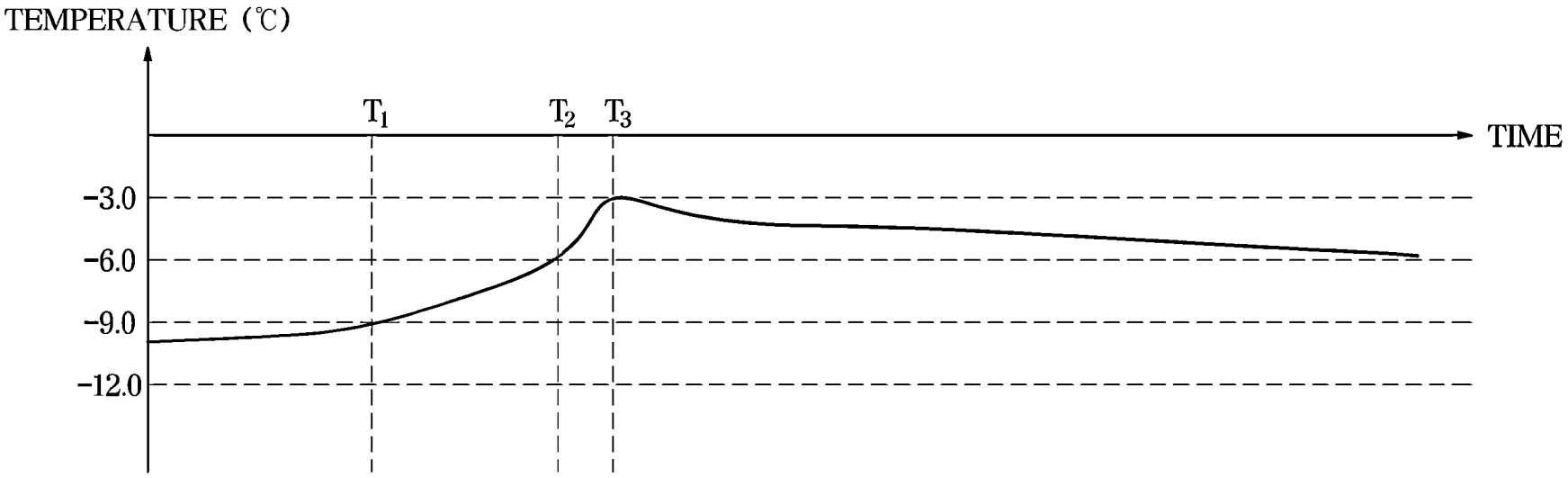

For example, the second reference time ΔT2 may be experimentally or empirically set to allow the defrosting of the evaporator 57 and the defrosting of the ice making refrigerant pipe 59 to be substantially simultaneously completed. As shown in FIG. 10A, the controller 210 may operate the first defrost heater 57*c* at a time T0 and the second defrost heater 59*a* at a time T1. There may be a time difference of the second reference time ΔT2 between the time T0 and the time T1. The controller 210 may substantially simultaneously stop the first defrost heater 57*c* and the second defrost heater 59*a* at the time T2. In addition, the controller 210 may resume the cooling and ice-making at a time T3, at which the third reference time ΔT3 is expired since the first defrost heater 57*c* and the second defrost heater 59*a* are stopped.

The internal temperature of the ice making device 60 may depend on the operation of the second defrost heater 59*a* and the ice-making operation. According to FIG. 10B, the internal temperature of the ice making device 60 is increased from the time T1, at which the second defrost heater 59*a* is operated, to the time T3, at which the ice making is resumed, and the internal temperature of the ice making device 60 is reduced after at the time T3 at which the ice-making is resumed.

In this case, the second reference time ΔT2 may be pre-determined upon the design of the refrigerator 1. A period of time required to complete the defrosting of the evaporator 57 may depend on the size of the evaporator 57 and the temperature of the evaporator 57 at the start of the defrosting. In addition, a period of time required to complete the defrosting of the ice making refrigerant pipe 59 may depend on the size of the ice making refrigerant pipe 59 and the temperature of the ice making refrigerant pipe 59 at the start of the defrosting. The period of time required to complete the defrosting of the evaporator 57 and the ice making refrigerant pipe 59 may be experimentally or empirically obtained, respectively, and the second reference time ΔT2 may be pre-set based on the period of time required to complete the defrosting of the evaporator 57 and the ice making refrigerant pipe 59 that is experimentally or empirically obtained.

Alternatively, the second reference time ΔT2 may be set by the controller 210 during the operation of the refrigerator 1. In response to the start of the evaporator 57, the controller 210 may obtain the temperature of the evaporator 57 using the first temperature sensor 231 and obtain the temperature of the ice making refrigerant pipe 59 (or the ice making tray) using the second temperature sensor 232. The controller 210 may determine the period of time required to complete the defrosting of the evaporator 57 based on the temperature of the evaporator 57. The controller 210 may determine the period of time required to complete the defrosting of the ice making refrigerant pipe 59 based on the temperature of the ice making refrigerant pipe 59. Further, the controller 210 may identify the second reference time ΔT2 based on the period of time required to complete the defrosting of the evaporator 57 and the ice making refrigerant pipe 59, respectively.

Figure 11A:
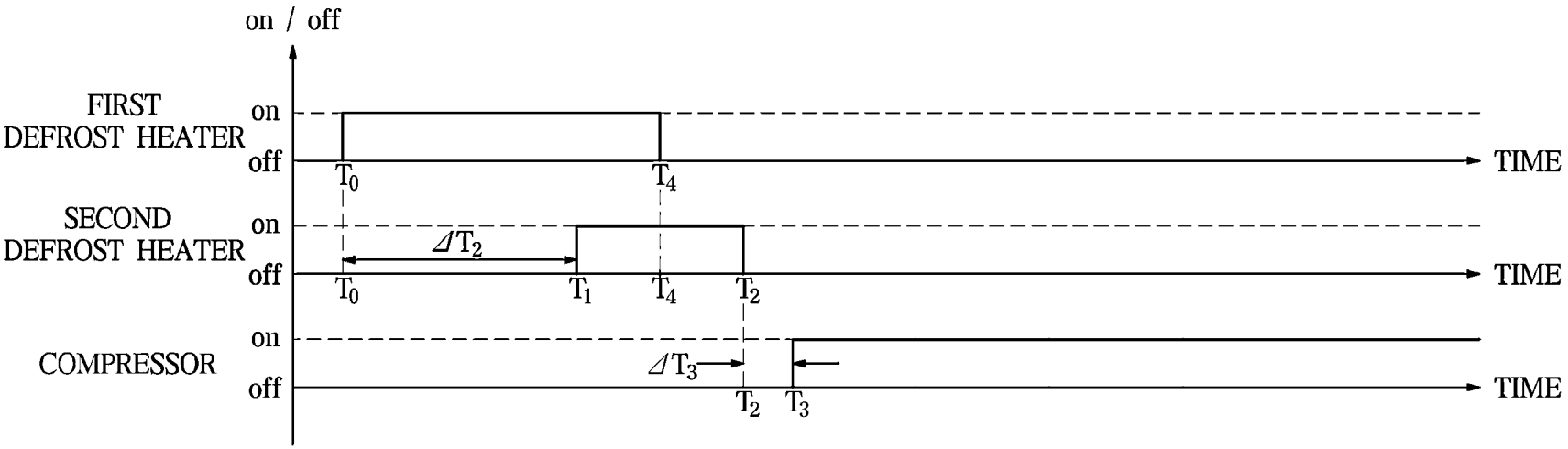
FIGS. 11A and 11B are views illustrating another example of the operation of the defrost heater and the internal temperature of the ice making device by the defrosting operation shown in FIG. 9.
Figure 11B:
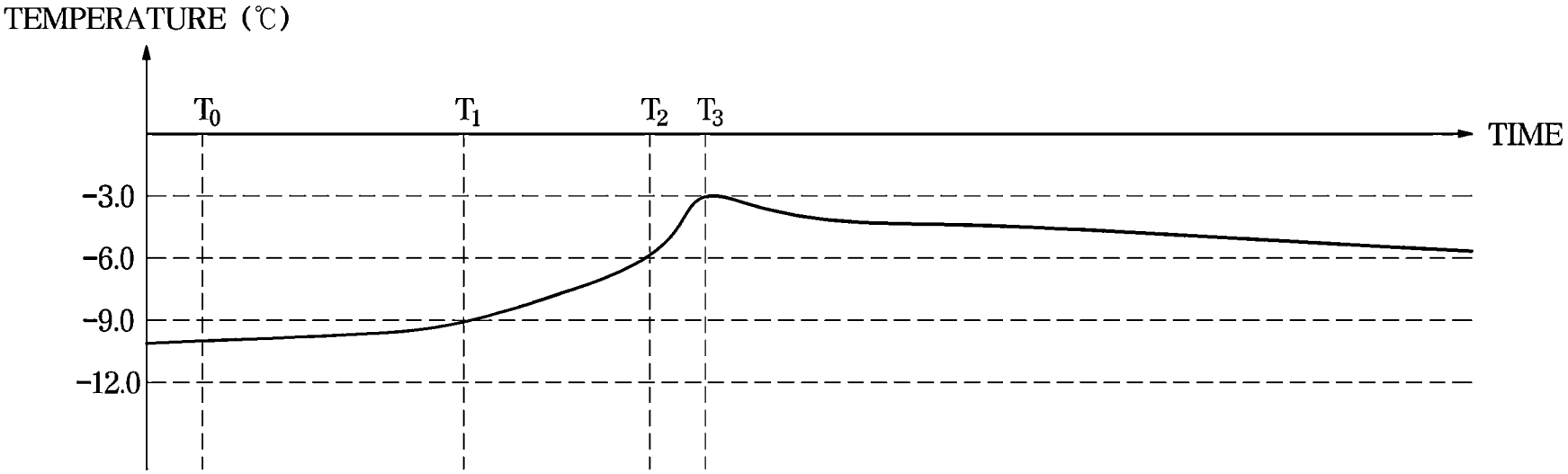
Figure 12A:
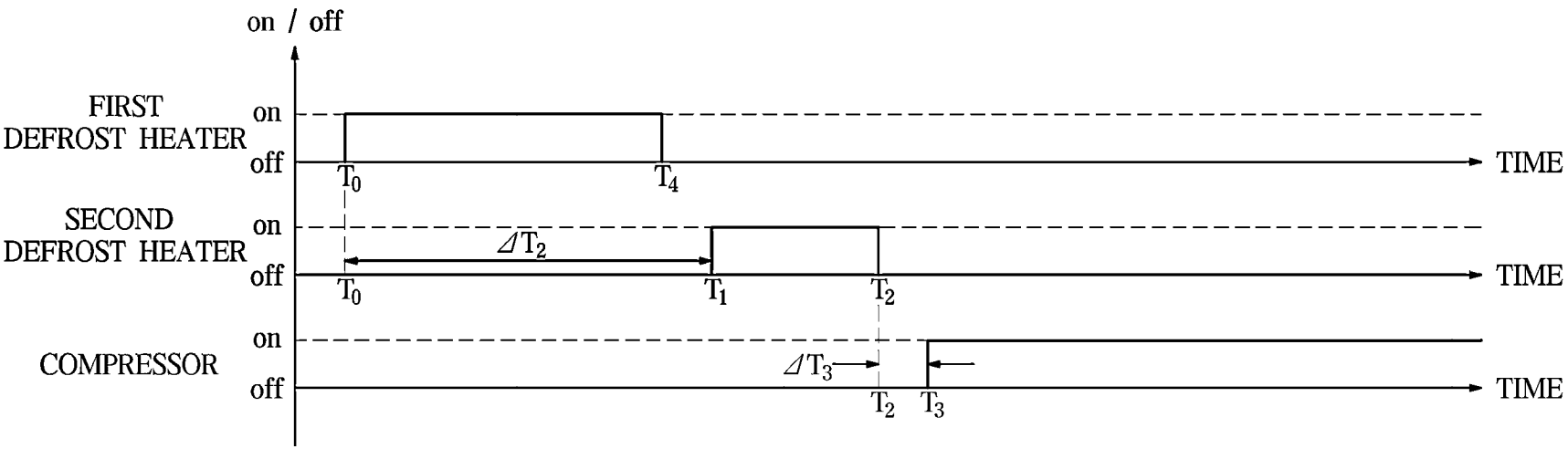
FIGS. 12A and 12B are views illustrating another example of the operation of the defrost heater and the internal temperature of the ice making device by the defrosting operation shown in FIG. 9.
Figure 12B:
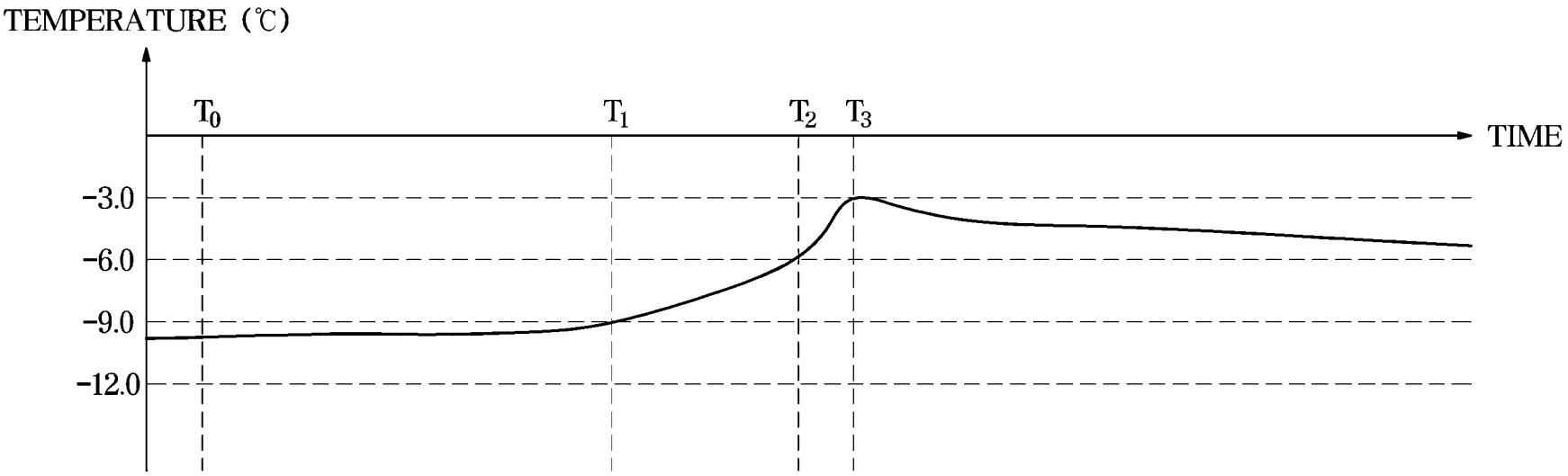

As another example, the second reference time ΔT2 may be set experimentally or empirically to allow the defrosting of the ice making refrigerant pipe 59 to be completed later than the defrosting of the evaporator 57. As shown in FIGS. 11A and 12A, the controller 210 may operate the first defrost heater 57*c* at a time T0, and may operate the second defrost heater 59*a* at a time T1 at which the second reference time ΔT2 is expired. The controller 210 may stop the first defrost heater 57*c* at a time T4 and stop the second defrost heater 59*a* at a time T2 that is later than the time T4. At this time, the second defrost heater 59*a* is operated before the first defrost heater 57*c* is stopped as shown in FIG. 11A or the second defrost heater 59*a* is operated after the first defrost heater 57*c* is stopped as shown in FIG. 12A. Further, the controller 210 may resume the cooling and ice-making at a time T3 at which the third reference time ΔT3 is expired since the first defrost heater 57*c* and the second defrost heater 59*a* are stopped.

The internal temperature of the ice making device 60 may depend on the operation of the second defrost heater 59*a* and the ice making operation. According to the FIGS. 11B and 12B, the internal temperature of the ice making device 60 is increased from the time T1, at which the second defrost heater 59*a* is operated, to the time T3, at which the ice making is resumed. The internal temperature of the ice making device 60 is reduced after the time T3 at which the ice making is resumed.

At this time, the second reference time ΔT2 may be pre-set upon the design of the refrigerator 1 so as to allow the defrosting of the evaporator 57 to be completed later than the defrosting of the ice making refrigerant pipe 59. Alternatively, during the operation of the refrigerator 1, the second reference time ΔT2 may be set by the controller 210 so as to allow the defrosting of the evaporator 57 to be completed later than the defrosting of the ice making refrigerant pipe 59.

As another example, the second reference time ΔT2 may be set experimentally or empirically to allow the defrosting of the ice making refrigerant pipe 59 to be completed faster than the defrosting of the evaporator 57 within a predetermined fourth reference time ΔT4.

As mentioned above, it is appropriate that the defrosting of the ice making refrigerant pipe 59 is competed later than the defrosting of the evaporator 57 in order to prevent the ice stored in the ice making device 60 from being melted. However, it is acceptable that the defrosting of the ice making refrigerant pipe 59 is competed faster than the defrosting of the evaporator 57. Therefore, it is acceptable that the defrosting of the ice making refrigerant pipe 59 is completed faster than the defrosting of the evaporator 57 within a predetermined time Tr.

Figure 13A:
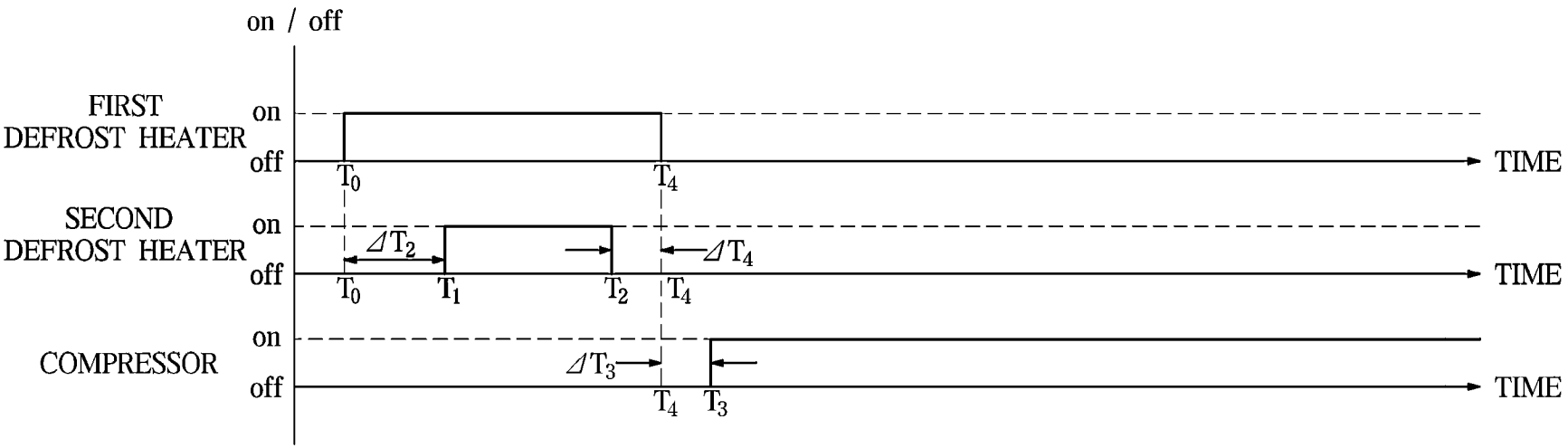
FIGS. 13A and 13B are views illustrating another example of the operation of the defrost heater and the internal temperature of the ice making device by the defrosting operation shown in FIG. 9.

As shown in FIG. 13A, the controller 210 may operate the first defrost heater 57*c* at a time T0, and may operate the second defrost heater 59*a* at a time T1 at which the second reference time ΔT2 is expired. The controller 210 may stop the second defrost heater 59*a* at the time T2 and stop the first defrost heater 57*c* at a time T4 later than the time T2. At this time, the controller 210 may control the first defrost heater and the second defrost heater 57*c* and 59*a* to allow a difference between the time T2, at which the second defrost heater 59*a* is stopped, and the time T4, at which the first defrost heater 57*c* is stopped, to be less than the fourth reference time ΔT4.

Figure 13B:
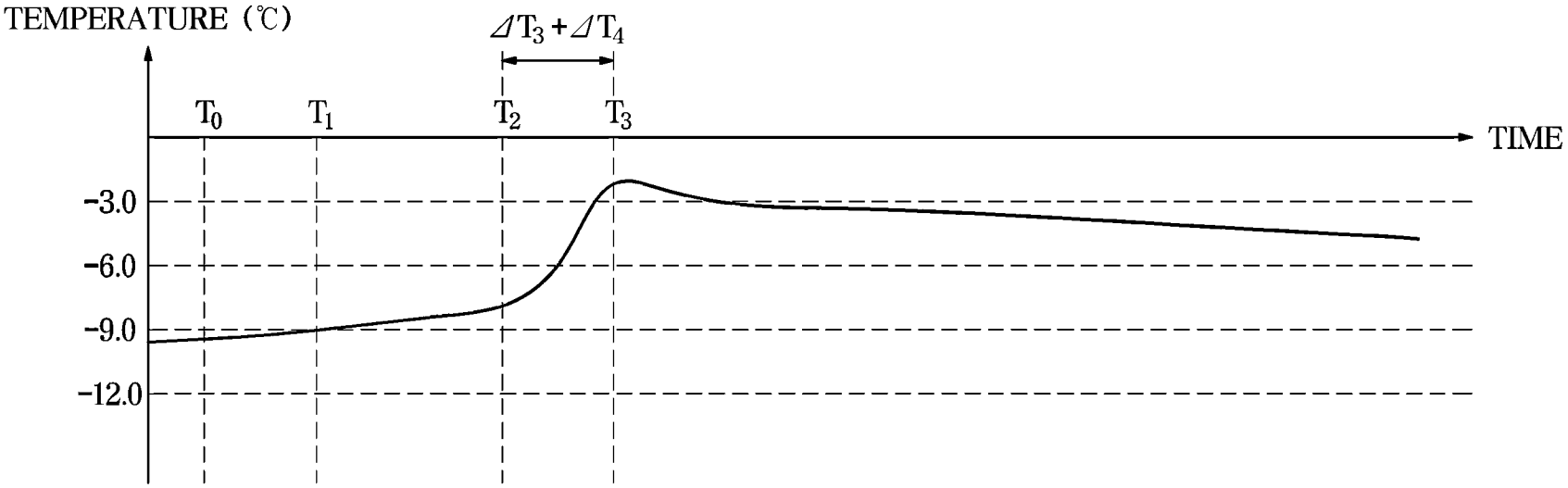

The fourth reference time ΔT4 may be set in a range in which the ice stored in the ice making device 60 is not melted. According to FIG. 13B, the internal temperature of the ice making device 60 is increased from the time T1, at which the second defrost heater 59*a* is operated, to the time T3 at which the ice making is resumed. The internal temperature of the ice making device 60 is reduced after the time T3 at which the ice making is resumed. At this time, a period of time from the stop of the second defrost heater 59*a* to the resumption of the ice-making may be the same as a sum of the third reference time ΔT3 and the fourth reference time ΔT4. In other words, the period of time from the stop of the second defrost heater 59*a* to the resumption of the ice-making may be increased. Accordingly, as shown in FIG. 13B, the temperature of ice stored in the ice making device 60 may be increased to minus 3 degrees Celsius or more. The fourth reference time ΔT4 may be set to allow the temperature of ice stored in the ice making device 60 to be maintained at a temperature below 0 (zero) degrees Celsius.

As mentioned above, the refrigerator 1 may first start to defrost of the evaporator 57, and in response to that the second reference time is expired since the defrosting of the evaporator 57 is started, the refrigerator 1 may start to defrost the ice making refrigerant pipe 59.

In this case, the second reference time may be set in various ways. For example, the second reference time may be set to allow the defrosting of the evaporator 57 and the defrosting of the ice making refrigerant pipe 59 to be substantially simultaneously terminated, or to allow the defrosting of the evaporator 57 to be terminated earlier than the defrosting of the ice making refrigerant pipe 59, or to allow the defrosting of the ice making refrigerant pipe 59 to be terminated earlier than the defrosting of the evaporator 57 within a predetermined range of time.

As mentioned above, by allowing the defrosting of the evaporator 57 to be terminated simultaneously with the defrosting of the ice making refrigerant pipe 59 or by allowing the defrosting of the evaporator 57 to be terminated earlier than the defrosting of the ice making refrigerant pipe 59, it is possible to prevent the ice stored in the ice storage 190 from being melted. Further, by allowing the defrosting of the evaporator 57 to be terminated later than the defrosting of the ice making refrigerant pipe 59 within a predetermined range of time, it is possible to prevent the ice stored in the ice storage 190 from being melted.

In the drawings and the above description, it has been described that, after the defrosting of the evaporator 57 configured to supply cooled air (hereinafter referred to as "cold air") to the freezing compartments 20*b* and 20*c* is started, the defrosting of the ice making refrigerant pipe 59 configured to make ice is started. However, it is not limited thereto. For example, the refrigerator 1 may include an additional evaporator configured to supply cold air to the refrigerating compartment 20*a*, and thus the defrosting of the ice making refrigerant pipe 59 may be started after the defrosting of the evaporator 57 and the defrosting of the additional evaporator are started.

The refrigerator according to an embodiment may include the storage compartment, the evaporator configured to cool the air in the storage compartment, the first heater provided in the vicinity of the evaporator, the tray provided to accommodate water, the refrigerant pipe provided in contact with the tray and configured to cool the tray, the second heater provided in the vicinity of the refrigerant pipe, the compressor configured to supply a compressed refrigerant to at least one of the evaporator or the refrigerant pipe, and the processor configured to start an operation of the second heater after starting an operation of the first heater, and configured to start an operation of the compressor after stopping the operation of the first heater and the second heater.

The processor may start the operation of the second heater after stopping the operation of the first heater or the processor may start the operation of the second heater in response to that the first time is expired after starting the operation of the first heater.

The processor may allow the second heater to be stopped later than the first heater.

The processor may simultaneously stop the operation of the first heater and the operation of the second heater, or stop the operation of the second heater after stopping the operation of the first heater. The processor may start the ice making by using the refrigerant pipe immediately after stopping the operation of the second heater. Accordingly, it is possible to prevent the ice from being melted caused by the heat emitted from the second heater.

The processor may stop the operation of the first heater within a predetermined time after stopping the operation of the second heater. The processor may start the ice-making by using the refrigerant pipe within a short time after stopping the operation of the second heater. Accordingly, it is possible to prevent the ice from being melted caused by the heat emitted from the second heater.

Exemplary embodiments of the present disclosure have been described above. In the exemplary embodiments described above, some components may be implemented as a "module". Here, the term 'module' means, but is not limited to, a software and/or hardware component, such as a Field Programmable Gate Array (FPGA) or Application Specific Integrated Circuit (ASIC), which performs certain tasks. A module may advantageously be configured to reside on the addressable storage medium and configured to execute on one or more processors.

Thus, a module may include, by way of example, components, such as software components, object-oriented software components, class components and task components, processes, functions, attributes, procedures, subroutines, segments of program code, drivers, firmware, microcode, circuitry, data, databases, data structures, tables, arrays, and variables. The operations provided for in the components and modules may be combined into fewer components and modules or further separated into additional components and modules. In addition, the components and modules may be implemented such that they execute one or more CPUs in a device.

With that being said, and in addition to the above described exemplary embodiments, embodiments can thus be implemented through computer readable code/instructions in/on a medium, e.g., a computer readable medium, to control at least one processing element to implement any above described exemplary embodiment. The medium can correspond to any medium/media permitting the storing and/or transmission of the computer readable code.

The computer-readable code can be recorded on a medium or transmitted through the Internet. The medium may include Read Only Memory (ROM), Random Access Memory (RAM), Compact Disk-Read Only Memories (CD-ROMs), magnetic tapes, floppy disks, and optical recording medium. Also, the medium may be a non-transitory computer-readable medium. The media may also be a distributed network, so that the computer readable code is stored or transferred and executed in a distributed fashion. Still further, as only an example, the processing element could include at least one processor or at least one computer processor, and processing elements may be distributed and/or included in a single device.

While exemplary embodiments have been described with respect to a limited number of embodiments, those skilled in the art, having the benefit of this disclosure, will appreciate that other embodiments can be devised which do not depart from the scope as disclosed herein. Accordingly, the scope should be limited only by the attached claims.

As is apparent from the above description, the refrigerator may resume the ice-making operation immediately or within a short period of time after the defrosting operation of the ice making device. Accordingly, it is possible to prevent ice from being agglomerated caused by the defrosting operation.

Although a few embodiments of the disclosure have been shown and described, it would be appreciated by those skilled in the art that changes may be made in these embodiments without departing from the principles and spirit of the disclosure, the scope of which is defined in the claims and their equivalents.

Although the present disclosure has been described with various embodiments, various changes and modifications may be suggested to one skilled in the art. It is intended that the present disclosure encompass such changes and modifications as fall within the scope of the appended claims.

What is claimed is:

1. A refrigerator comprising:

an evaporator;

a first defrost heater provided in a vicinity of the evaporator;

an ice-making tray:

a refrigerant pipe configured to cool the ice-making tray;

a switching valve provided in the refrigerant pipe;

a second defrost heater provided in contact with the ice-making tray and in a vicinity of the refrigerant pipe such that heat generated by the second defrost heater is conducted to the ice-making tray and the refrigerant pipe;

a compressor configured to supply a refrigerant to at least one of the evaporator or the refrigerant pipe, wherein the refrigerant discharged from the compressor flows into the refrigerant pipe, and the refrigerant discharged from the refrigerant pipe flows into the evaporator; and a processor configured to:

start an operation of the first defrost heater to remove frost from the evaporator located downstream in a refrigerant path and start an operation of the second defrost heater to remove frost from the refrigerant pipe located upstream in the refrigerant path;

stop the operation of the second defrost heater only when both (i) a temperature of the ice-making tray or the refrigerant pipe is equal to or greater than a second reference temperature and (ii) a predetermined minimum defrosting time has elapsed since starting the operation of the second defrost heater;

start an operation of the compressor after stopping the operation of the second defrost heater; and control the switching valve to allow the refrigerant to be supplied to the refrigerant pipe during the operation of the compressor while the operations of the first defrost heater and the second defrost heater remain stopped.

2. The refrigerator of claim 1, wherein the processor is further configured to start the operation of the compressor after stopping the operation of the first defrost heater and the second defrost heater.

3. The refrigerator of claim 1, wherein the processor is further configured to simultaneously stop the operation of the first defrost heater and the operation of the second defrost heater.

4. The refrigerator of claim 1, wherein the processor is further configured to stop the operation of the second defrost heater after stopping the operation of the first defrost heater.

5. The refrigerator of claim 1, wherein the processor is further configured to stop the operation of the first defrost heater within a predetermined time after stopping the operation of the second defrost heater.

6. The refrigerator of claim 1, further comprising:

a first temperature sensor configured to measure a temperature of the evaporator, wherein the processor is further configured to stop the operation of the first defrost heater based on the temperature of the evaporator being equal to or greater than a first reference temperature.

7. The refrigerator of claim 1, further comprising:

a second temperature sensor configured to measure a temperature of the ice-making tray.

8. The refrigerator of claim 1, wherein the refrigerant pipe is an ice-making refrigerant pipe; and wherein the second defrost heater is configured to heat the ice-making tray, and the ice-making refrigerant pipe to remove frost formed on the refrigerant pipe.

9. A control method of a refrigerator comprising:

starting an operation of a compressor to supply a refrigerant to an evaporator and a refrigerant pipe in contact with an ice-making tray, where the refrigerant pipe is configured to cool the ice-making tray;

starting an operation of a first defrost heater provided in a vicinity of the evaporator to remove frost from the evaporator in response to stopping the operation of the compressor;

stopping the operation of the first defrost heater;

in response to the stopping of the operation of the first defrost heater, starting a predetermined first timer;

elapsing the predetermined first timer;

starting an operation of a second defrost heater provided in contact with the ice-making tray and in a vicinity of the refrigerant pipe to remove frost from the refrigerant pipe, in response to the elapse of the predetermined first timer, wherein heat generated by the second defrost heater is conducted to the ice-making tray and the refrigerant pipe;

stopping the operation of the second defrost heater only when both (i) a temperature of the ice-making tray or the refrigerant pipe is equal to or greater than a second reference temperature and (ii) a predetermined minimum defrosting time has elapsed since starting the operation of the second defrost heater;

starting the operation of the compressor after stopping the operation of the second defrost heater; and controlling a switching valve to allow the refrigerant to be supplied to the refrigerant pipe during the operation of the compressor, which the switching valve is provided in the refrigerant pipe.

10. The control method of claim 9, wherein the starting of the operation of the compressor comprises starting the operation of the compressor after stopping the operation of the first defrost heater and the second defrost heater.

11. The control method of claim 9, wherein the stopping of the operation of the first defrost heater and the second defrost heater comprises simultaneously stopping the operation of the first defrost heater and the operation of the second defrost heater.

12. The control method of claim 9, wherein the stopping of the operation of the first defrost heater and the second defrost heater comprises stopping the operation of the second defrost heater after stopping the operation of the first defrost heater.

13. The control method of claim 9, wherein the stopping of the operation of the first defrost heater and the second defrost heater comprises stopping the operation of the first defrost heater within a predetermined time after stopping the operation of the second defrost heater.

14. The control method of claim 9, wherein the stopping of the operation of the first defrost heater and the second defrost heater comprises:

stopping the operation of the first defrost heater based on a temperature of the evaporator being equal to or greater than a first reference temperature.

15. The control method of claim 9, further comprising:

stopping the operation of the second defrost heater after stopping the operation of the first defrost heater.

16. A refrigerator comprising:

an evaporator;

a first defrost heater provided in a vicinity of the evaporator;

a refrigerant pipe provided in contact with an ice-making tray;

a switching valve provided in the refrigerant pipe;

a second defrost heater provided in contact with the ice-making tray and in a vicinity of the refrigerant pipe such that heat generated by the second defrost heater is conducted to the ice-making tray and the refrigerant pipe;

a compressor configured to supply a refrigerant to at least one of the evaporator or the refrigerant pipe; and a processor configured to:

start an operation of the first defrost heater to heat the evaporator;

stop the operation of the first defrost heater;

in response to the stopping of the operation of the first defrost heater, start a predetermined first timer;

elapse the predetermined first timer;

start an operation of the second defrost heater to heat the refrigerant pipe, in response to the elapse of the predetermined timer;

stop the operation of the second defrost heater after stopping the operation of the first defrost heater and only when both (i) a temperature of the ice-making tray or the refrigerant pipe is equal to or greater than a second reference temperature and (ii) a predetermined minimum defrosting time has elapsed since starting the operation of the second defrost heater;

start an operation of the compressor after stopping the operation of the second defrost heater; and control the switching valve to allow the refrigerant to be supplied to the refrigerant pipe during the operation of the compressor.

17. The refrigerator of claim 16, wherein the processor is further configured to start the operation of the compressor after stopping the operation of the first defrost heater and the second defrost heater.

18. The refrigerator of claim 16, further comprising:

a first temperature sensor configured to measure a temperature of the evaporator, wherein the processor is further configured to stop the operation of the first defrost heater based on the temperature of the evaporator being equal to or greater than a first reference temperature.

19. The refrigerator of claim 16, further comprising:

a second temperature sensor configured to measure a temperature of the ice-making tray.

* * * * *